United States Patent [19]

Yamagami

[11] Patent Number: 4,946,767

[45] Date of Patent: Aug. 7, 1990

[54] SILVER HALIDE COLOR PHOTOGRAPHIC MATERIAL

[75] Inventor: Hiroyuki Yamagami, Kanagawa, Japan

[73] Assignee: Fuji Photo Film Co., Ltd., Kanagawa, Japan

[21] Appl. No.: 248,005

[22] Filed: Sep. 23, 1988

[30] Foreign Application Priority Data

Sep. 25, 1987 [JP] Japan ..... 62-240179

[51] Int. Cl.[5] ..... G03C 1/46

[52] U.S. Cl. ..... 430/505; 430/503; 430/506; 430/507; 430/510; 430/517; 430/543; 430/562; 430/572; 430/950

[58] Field of Search ..... 430/950, 507, 503, 572, 430/562, 506, 543, 505, 510, 517

[56] References Cited

U.S. PATENT DOCUMENTS 4,165,236 8/1979 Aotsuka ..... 430/506

4,414,308 11/1983 Hamada ..... 430/506

4,639,409 1/1987 Yamamoto et al. ..... 430/506

FOREIGN PATENT DOCUMENTS 2176304 12/1983 United Kingdom .

*Primary Examiner*—Paul R. Michl

*Assistant Examiner*—Thorl Chea

*Attorney, Agent, or Firm*—Sughrue, Mion. Zinn, Macpeak & Seas

[57] ABSTRACT

A silver halide color photographic material composed of a support having thereon at least one light-sensitive silver halide emulsion layer, the material having a specific photographic sensitivity of at least 320 and a surface spectral reflectance of from 20% to less than 35% at a wavelength of 600 nm on the emulsion side film surface. The high sensitivity color photographic light-sensitive material provides superior exposure when used in an automatic exposure camera.

17 Claims, No Drawings

SILVER HALIDE COLOR PHOTOGRAPHIC MATERIAL

FIELD OF THE INVENTION

The present invention relates to a color photographic light-sensitive material. More particularly, the present invention relates to a high sensitive color photographic light-sensitive material capable of preventing a substantial under-exposure when an automatic exposure camera is used for photographing.

BACKGROUND OF THE INVENTION

In recent years, as great progress has been made in the technology of photographic light-sensitive materials for photographing, many high sensitive light-sensitive materials have become commercially available. The expansion of photographing application has been made by using such high sensitive light-sensitive materials for photographing in a dark room without using a strobe, or sports photography with a telephoto lens at a high shutter speed.

Furthermore, cameras, particularly single-lens reflex cameras, having an automatic exposure function have recently become widely used. These cameras have a mechanism in which the light reflected by the film surface upon exposure is received by a light receiving element, which in turn integrates the reflected light into data which are then fed back to determine the shutter time or the amount of light emitted by the strobe.

However, high sensitive color negative films so far developed, e.g., ISO 400 color negative film, are disadvantageous in that they have a higher reflectance on the film surface (emulsion surface side) than an ISO 100 color negative film, causing an increase in the amount of light received by the light receiving element in the automatic exposure meter in the camera, which leads to substantial under-exposure. ISO 400 high sensitive color negative films which are now commercially available have a spectral reflectance of 35% or more at a wavelength of 600 nm on the film surface (emulsion side).

SUMMARY OF THE INVENTION

One object of the present invention to provide a high sensitive color photographic light-sensitive material capable of preventing substantial under-exposure when an automatic exposure camera is used for photographing.

This and other objects of the present invention will become more apparent from the following detailed description and examples.

It has now been found that these and other objects of the present invention are attained by a silver halide color photographic material composed of a support having thereon at least one light-sensitive silver halide emulsion layer, the material having a specific photographic sensitivity of at least 320 and a surface spectral reflectance of from 20% to less than 35% at a wavelength of 600 nm on the film surface (emulsion side).

DETAILED DESCRIPTION OF THE INVENTION

The predetermined surface reflectance can be effectively accomplished by properly combining the following various approaches for higher sensitivity:

(1) The use of a yellow filter dye as described later;

(2) The use of a sensitizing dye as described later;

(3) The use of grains of silver halide such as silver iodide and silver iodide-containing silver halide, particularly, of grains having a core/shell double structure in which the silver iodide content is high in the core but low in the shell;

(4) The use of a two-equivalent coupler;

(5) The use of a high speed reaction coupler;

(6) The improvement in the light utilization effect of the lower layer by providing two or more layers in each color-sensitive layer and giving a low silver content to the upper layer; and (7) The use of silver halide grains having a content of metal impurity other than gold and iridium of 3 ppm or less. Furthermore, these approaches can be combined with fine silver halide grains. In order to accomplish these and other objects of the present invention, it is preferred that the combined total of silver contents is 3.0 to 9.0 g/m$^2$. The combined total of silver contents can be preferably accomplished by properly combining the above-described various approaches (1) to (7).

In the present invention, the specific photographic sensitivity as described in detail and specified hereinafter is used as the sensitivity of a photographic light-sensitive material for the reason described hereinafter.

Particularly, as a measure of the sensitivity of a photographic material ISO sensitivity, which is an international standard, is generally used. In the ISO sensitivity specification, it is prescribed that the light-sensitive material to be measured is developed 5 days after exposure in the manner specified by each company. In the present invention, the time between exposure and development is shortened to 0.5 to 6 hours. Furthermore, a specific photographic sensitivity as described later is employed so that the sensitivity can be determined by a predetermined development process.

The specific photographic sensitivity as used herein is determined in accordance with the test method as described below, which corresponds to the ISO sensitivity test (JIS K No. 7614-1981).

(1) Test conditions

The test is effected in a room at a temperature of 20°±5° C. and a relative humidity of 60±10%. The light-sensitive material specimen to be tested is allowed to stand under such conditions for 1 hour or longer before use.

(2) Exposure i. The relative spectral energy distribution of the standard light at the exposed surface is as shown in Table 1.

TABLE 1

| Wavelength nm | Relative spectral energy (1) |
|---|---|
| 360 | 2 |
| 370 | 8 |
| 380 | 14 |
| 390 | 23 |
| 400 | 45 |
| 410 | 57 |
| 420 | 63 |
| 430 | 62 |
| 440 | 81 |
| 450 | 93 |
| 460 | 97 |
| 470 | 98 |
| 480 | 101 |
| 490 | 97 |
| 500 | 100 |
| 510 | 101 |
| 520 | 100 |

TABLE 1-continued

| Wavelength nm | Relative spectral energy (1) |
|---|---|
| 530 | 104 |
| 540 | 102 |
| 550 | 130 |
| 560 | 100 |
| 570 | 97 |
| 580 | 98 |
| 590 | 90 |
| 600 | 93 |
| 610 | 94 |
| 620 | 92 |
| 630 | 88 |
| 640 | 89 |
| 650 | 86 |
| 660 | 86 |
| 670 | 89 |
| 680 | 85 |
| 690 | 75 |
| 700 | 77 |

Note (1): The value of the relative spectral energy is determined relative to the value at 560 nm as 100.

ii. The variation in the illuminance at the exposure surface is made by means of an optical wedge. In any portion of such an optical wedge, the fluctuation in the spectral transmission density is 10% or less in the wavelength region of 360 nm to less than 400 nm and 5% or less in the wavelength region of 400 nm to 700 nm.

iii. The exposure time is 1/1000 second.

(3) Development i. The light-sensitive material to be tested is kept at a temperature of 20°±5° C. and a relative humidity of 60±10% between exposure and development.

ii. The development of the light-sensitive material is completed in 30 minutes to 6 hours after exposure.

iii. The development is effected as follows:

1. Color development: 3 min. 15 sec., 38.0°±0.1° C.
2. Bleach: 6 min. 30 sec., 38.0°±3.0° C.
3. Rinse: 3 min. 15 sec., 24°–41° C.
4. Fixing: 6 min. 30 sec., 38.0°±3.0° C.
5. Rinse: 3 min. 15 sec., 24°–41° C.
6. Stabilizing: 3 min. 15 sec., 38.0°±3.0° C.
7. Drying: 50° C. or below The composition of the processing solutions to be used are as follows:

| | |
|---|---|
| **Color developing solution** | |
| Diethylenetriaminepentaacetic acid | 1.0 g |
| 1-Hydroxyethylidene-1,1-diphosphonic acid | 2.0 g |
| Sodium sulfite | 4.0 g |
| Potassium carbonate | 30.0 g |
| Potassium bromide | 1.4 g |
| Potassium iodide | 1.3 mg |
| Hydroxylaminesulfuric acid | 2.4 g |
| 4-(N-ethyl-N-β-hydroxylethylamino)-2-methylaniline sulfate | 4.5 g |
| Water to make | 1.0 l |
| pH | 10.0 |
| **Bleaching solution** | |
| Ammonium ethylenediaminetetraacetato ferrate | 100.0 g |
| Disodium ethylenediaminetetraacetate | 10.0 g |
| Ammonium bromide | 150.0 g |
| Ammonium nitrate | 10.0 g |
| Water to make | 1.0 l |
| pH | 6.0 |
| **Fixing solution** | |
| Disodium ethylenediaminetetraacetate | 1.0 g |
| Sodium sulfite | 4.0 g |
| 70% aqueous solution of ammonium thiosulfate | 175.0 ml |
| Sodium bisulfite | 4.6 g |
| Water to make | 1.0 l |

-continued

| | |
|---|---|
| pH | 6.6 |
| **Stabilizing solution** | |
| Formalin (40%) | 2.0 ml |
| Polyoxyethylene-p-monononylphenylether (average polymerization degree:10) | 0.3 g |
| Water to make | 1.0 l |

(4) Measurement of density (JIS K No. 7605)

The density is represented in $\log_{10}(\phi_0/\phi)$ in which $\phi_0$ represents an illumination luminous flux for density measurement and $\phi$ represents a luminous flux transmitted by the portion to be measured. In the geometry of the density measurement, the illumination luminous flux is a parallel luminous flux in the normal direction. As the transmission luminous flux there is used the entire luminous flux which diffuse into a semisphere. If other measurement methods are used, corrections are made by means of a standard density unit. In the measurement, the emulsion film surface is placed opposed to the receptor side. The density measurement is made for blue, green and red status M densities. The spectral characteristics of these status M densities are properly adjusted so that the total characteristics of the light source, optical system, optical filter and receptor which constitutes the densitometer are as shown in Table 2.

TABLE 2

Spectal characteristics of status M density (Value represented in logarithms with the peak value as 5.00)

| Wavelength nm | Blue | Green | Red |
|---|---|---|---|
| 400 | * | | |
| 410 | 2.10 | | |
| 420 | 4.11 | | |
| 430 | 4.63 | * | |
| 440 | 4.37 | | |
| 450 | 5.00 | | |
| 460 | 4.95 | | |
| 470 | 4.74 | 1.13 | |
| 480 | 4.34 | 2.19 | |
| 490 | 3.74 | 3.14 | |
| 500 | 2.99 | 3.79 | |
| 510 | 1.35 | 4.25 | * |
| 520 | | 4.61 | |
| 530 | | 4.85 | |
| 540 | | 4.98 | |
| 550 | | 4.98 | |
| 560 | | 4.80 | |
| 570 | ** | 4.44 | |
| 580 | | 3.90 | |
| 590 | | 3.15 | |
| 600 | | 2.22 | |
| 610 | | 1.05 | |
| 620 | | | 2.11 |
| 630 | | | 4.48 |
| 640 | | | 5.00 |
| 650 | | | 4.90 |
| 660 | | | 4.58 |
| 670 | | | 4.25 |
| 680 | | ** | 3.88 |
| 690 | | | 3.49 |
| 700 | | | 3.10 |
| 710 | | | 2.69 |
| 720 | | | 2.27 |
| 730 | | | 1.86 |
| 740 | | | 1.45 |
| 750 | | | 1.05 |
| | | ** | |

*red slope 0.260/nm, green slope 0.106/nm, blue slope 0.250/nm

**red slope 0.040/nm, green slope 0.120/nm, blue slope 0.220/nm (5) Determination of specific photographic sensitivity With the results of the density measurement of the specimen processed under the conditions specified in (1) to (4), the specific photographic sensitivity is determined in the manner as described hereinafter.

i. The exposure corresponding to the minimum density for blue, green and red plus 0.15 is represented by lux.sec as $H_B$, $H_G$ and $H_R$, respectively.

ii. Whichever is higher, $H_B$ or $H_R$ (lower sensitivity), is referred to as $H_S$.

iii. The specific photographic sensitivity S is calculated in accordance with the following equation:

$$S = \sqrt{\frac{2}{H_G \times H_S}}$$

ISO 400 high sensitive color negative films which are now commercially available have a specific photographic sensitivity of about 320 to 420. as determined above. In order to improve the sensitivity and graininess, the industry has so far tended to increase the silver content as much as possible as described in JP-A-No. 58-147744 (The term "JP-A" as used herein means an "unexamined published Japanese patent application") (corresponding to U.S. Pat. No. 4,450,228). However, such a color negative film is poor in color reproduction and sharpness, and shows not only fog formation but also deterioration of graininess due to natural radiation in case of long-term preservation. Furthermore, such a color negative film tends to show a remarkable rise in the spectral reflectance on its surface (emulsion surface side). When such a color negative film is used with a camera provided with an automatic exposure meter, the light receiving element in the camera tends to receive more light than an ordinary color negative film having ISO sensitivity of 100 to 200. This gives an under-exposure relative to such an ordinary color negative film. In the present invention, such a disadvantage can be eliminated by providing a light-sensitive material having a surface (emulsion surface side) spectral reflectance of 20% to less than 35%, preferably 25% to less than 33%, particularly 25% to less then 30% at a wavelength of 600 nm.

The automatic exposure control system in such an automatic exposure camera is designed for automation of a series of exposure decision processes, including measurement of luminance of the object. The most important element of this control system is a light receiving element for measuring light. At present, as such a light receiving element for cameras, Si with a filter (silicon photodiode) or GaAsP (gallium arsenic phosphonium photodiode) photodiodes are mainly used. The peak of the spectral sensitivity of Si with a filter and GaAsP is in the vicinity of 550 to 620 nm and therefore, they are most sensitive to wavelengths in this vicinity. Accordingly, the spectral reflectance in this wavelength range is very important.

Most automatic exposure cameras are equipped with an automatic exposure control mechanism which uses light reflected by the film surface to control the exposure (amount of light emitted) upon flash photographing. When a color negative film having a high spectral reflectance outside the scope of the present invention is used with such a camera, the light-receiving element receives more light than desired, providing an under-exposure. This causes various deteriorations in picture quality. Particularly, if a high sensitive color negative film is used, such an under-exposure causes more deterioration in graininess than an over-exposure. Therefore, such a high sensitive film has some tolerance in a low range of reflectance but little or no tolerance in a high range of reflectance. Accordingly, the spectral reflectance on the film surface is preferably in the range of 20% to less than 35%, more preferably 25% to less than 33%, particularly 25% to less than 30%. Taking into consideration the versatility and application of color negative films, such a spectral reflectance should be provided in a high sensitive film having a specific sensitivity of 320 to 800, rather than to an ultrahigh sensitivity film having a specific sensitivity of 800 or more.

The surface spectral reflectance, i.e., the spectral reflectance of the surface of the material coated with the emulsion layers, can be determined by the following method. In the present invention, the spectral reflectance is determined by introducing light incident to the film surface at an angle of 45° and then measuring the reflected light using an integrating sphere, as described in Iro no Seishitsu to Gijutsu -Oyobutsuri Gakkai to Kogaku Konwakai Hen-, p.87, (1986), Asakurashoten.

The present invention can be applied to a multilayer color negative photographic light-sensitive material having at least two spectral sensitivities on a support. Such a multilayer color negative photographic light-sensitive material normally has at least one red-sensitive emulsion layer, one green-sensitive emulsion layer and one blue-sensitive emulsion layer on a support. The order of arrangement of these layers can be freely selected as desired. A commonly used layer arrangement is in the order of red-sensitive emulsion layer, green-sensitive emulsion layer and blue-sensitive emulsion layer outward from the support. Furthermore, a color-sensitive emulsion layer may be formed of two or more emulsion layers having the same color sensitivity but different sensitivities to attain the desired sensitivity. More preferably, such a color-sensitive emulsion layer may be formed of three emulsion layers to further improve the graininess. Such an approach is described in British Patent No. 923,045, and JP-B-No. 49-15495 (The term "JP-B" as used herein means an "examined Japanese patent application") (corresponding to U.S. Pat. No. 3,843,369).

In a color negative photographic light-sensitive material, when a color-sensitive emulsion layer is formed of two or more emulsion layers having the same color sensitivity but different sensitivities, a graininess elimination effect is utilized. It is therefore common in the industry to use an emulsion layer having a higher sensitivity with a higher silver content to obtain a high picture quality color negative photographic light-sensitive material. However, in a high sensitive color negative photographic light-sensitive material having a specific sensitivity of 320 to less than 800, if an emulsion layer having a higher sensitivity is provided with a higher silver content, it exhibits the disadvantage of a greater deterioration with time after preservation than a lower sensitive emulsion layer provided with a higher silver content. Therefore, the emulsion layer having the highest sensitivity in does different emulsions having the same color-sensitivity preferably does not have too high a silver content. The emulsion layer having the highest sensitivity in each of the red-sensitive emulsion layers, green-sensitive emulsion layers and blue-sensitive emulson layers preferably has a silver content of 0.3 to 1.8 g/m$^2$, more preferably 0.3 to 1.6 g/m$^2$, particularly 0.3 to 1.4 g/m$^2$.

Furthermore, in order to attain both high sensitivity and high picture quality at the same time, many layer arrangements have been proposed. These approaches may be used in the present invention, as described in U.S. Pat. Nos. 4,184,876, 4,129,446, 4,186,016, 4,186,011, 4,267,264, 4,173,479, 4,157,917, and 4,165,236, British Patent Nos. 1,560,955, 2,138,962, and 2,137,472, JP-A-No. 59-177552, JP-A-No. 59-180556 and JP-A-No. 59-204,038 (corresponding to U.S. Pat. No. 4,724,198).

A light-insensitive layer may be interposed between two or more emulsion layers having the same color-sensitivity.

A reflective layer made of fine silver halide grains or the like may be provided beneath a high sensitive layer, particularly a high sensitive blue-sensitive layer to improve the sensitivity. This approach is described in JP-A-No. 59-160135 (corresponding to U.S. Pat. No. 4,539,289).

In general, the red-sensitive emulsion layer contains a cyan-forming coupler, the green-sensitive emulsion layer contains a magenta-forming coupler and the blue-sensitive emulsion layer contains a yellow-forming coupler. However, different combinations may be employed if necessary. For example, a combination with an infrared-sensitive layer may be used to provide a light-sensitive material for a false color photograph or semiconductor laser exposure.

Alternatively, an emulsion layer provided with a proper combination of a color-sensitivity and a dye-forming coupler may be provided farthest from the support as described in U.S. Pat. No. 3,497,350 and JP-A-No. 59-214853 (corresponding to U.S. Pat. No. 4,647,527).

The photographic emulsion layer in the present silver halide photographic material of the present convention may contain any silver halide selected from silver bromide, silver bromoiodide, silver bromochloroiodide, silver bromochloride and silver chloride. As a suitable silver halide there may be used silver bromoiodide containing at most 30 mol % of silver iodide. A particularly preferred silver halide is silver bromoiodide having a silver iodide content of 2 to 20 mol %. Furthermore, in order to attain both high sensitivity and high picture quality at the same time, it is preferred that the average silver iodide content in silver halide contained in the total emulsion layers be 8 mol % or more as described in JP-A-No. 60-128443. It is known that if the average silver iodide content in silver halide is increased, the graininess thereof is remarkably improved. When the silver iodide content exceeds some value, some defects such as delay in development, desilvering and fixing appear. In the present invention, however, even if the silver iodide content is increased, these defects are negligible, probably because the silver content is small enough.

The silver halide grains to be incorporated in the present silver halide photographic material preferably have a double structure of a core substantially of silver bromoiodide with a silver iodide content of 5 mol % or more, and a shell covering the core and substantially of silver bromoiodide or silver bromide with a lower silver iodide content than the core. The silver iodide content of the core is more preferably in the range of 10 mol % or more, particularly 20 to 44 mol %. The silver iodide content of the shell is preferably in the range of 5 mol % or less. (see JP-A-No. 60-138538, JP-A-No. 61-88253, JP-A-No. 59-177535, JP-A-No. 61-112142 and JP-A-No. 60-143331)

The core may uniformly contain silver iodide or may have a multiplex structure comprising phases having different silver iodide contents. In the latter case, the phase having the highest silver iodide content has a silver iodide content of 5 mol % or more, preferably 10 mol % or more. Furthermore, the silver iodide content of the shell is preferably lower than that of the phase in the core having the highest silver iodide content. The term "core (or shell) substantially of silver bromoiodide" as used herein means a core (or shell) which mainly contains silver bromoiode but may contain other components in an amount of less than about 1 mol %.

Further preferred embodiments of the silver halide grains to be incorporated in the present silver halide photographic material are silver halide grains having such a structure that when (200) plane thereof is subjected to diffraction with K$\beta$-rays from Cu at a diffraction angle 2$\theta$ of 38° to 42° to obtain a diffraction intensity vs. diffraction angle curve in the manner as described in H. Hirsh, Journal of Photographic Science, Vol. 10, p. 129, (1962), there appear two maximum diffraction values corresponding to the core and shell, respectively, and one minimum diffraction value therebetween, and the diffraction intensity corresponding to the core is 1/10 to 3/1 of that of the shell. Particularly, the diffraction intensity ratio is preferably in the range of 1/5 to 3/1, more preferably $\frac{1}{3}$ to 3/1.

Such a double structure enables the use of an silver bromoiodide emulsion having a high iodine content without causing any delay in development. Such a silver bromoiodide emulsion can provide a light-sensitive material having an excellent graininess even if the coated amount of silver is small. (see JP-A-No. 60-138538, JP-A-No. 61-8253, JP-A-No. 59-177535, JP-A-No. 61-112142 and JP-A-No. 60-143331)

The silver halide emulsion layer to be used in the present invention preferably contains chemically-sensitized silver halide grains containing 3 ppm or less of metal impurities other than gold and iridium (for example, lead). Such a silver halide emulsion can provide a high sensitive silver halide photographic material.

The preparation of such an emulsion of silver halide grains having a remarkably small content of metal impurities other than gold and iridium can be accomplished not only by purifying materials essential for the preparation of the silver halide emulsion, such as water, hydrophilic colloid such as gelatin, soluble silver salt such as silver nitrate, and soluble halogenated alkali such as KBr, KCl, KI, NaBr and NaCl so that metal impurities are removed therefrom, but also by preventing metal impurities from entering into the reaction system from the material of the reaction vessel during the preparation of the silver halide emulsion or by properly combining techniques such as adjustment of reaction temperature or other reaction conditions.

The average size of silver halide grains to be incorporated in the present photographic emulsion (as determined in terms of grain diameter in the case of spherical particles or nearly spherical particles, or in terms of edge length in terms of cubic particles, as on average based on the projected area thereof) is not specifically limited but is preferably in the range of 0.05 to 10 $\mu$m. Where some color-sensitive emulsion layers are each formed of two or more emulsion layers, the average size of the silver halide grains to be incorporated in each of the emulsion layers having the highest sensitivity is preferably in the range of 0.5 to 4 μm, particularly 0.8 to 2.5 μm.

The distribution of grain sizes of silver halide may be narrow or wide.

The silver halide grains to be incorporated in the photographic emulsion for use in the present invention may have a regular crystal form, such as a cube and octahedron; an irregular crystal form such as a sphere and tabular; or a composite thereof The silver halide grains for use in the present invention may be a mixture of grains of silver halide having various crystal forms.

Alternatively, an emulsion of silver halide grains wherein ultratabular silver halide grains having a diameter of 5 times or more greater than the thickness thereof account for 50% or more of the total grains (as determined by projected area) may be used in the present invention.

The preparation of the photographic emulsion to be used in the present invention can be accomplished by any suitable method as described in P. Glafkides, *Chimie et Physique Photogranhique.* pp. 329 to 402, (Paul Montel, 1967); G. F. Duffin, *Photographic Emulsion Chemistry,* pp. 57 to 82, (Focal Press, 1966); and V. L. Zelikman et al, *Making and Coating Photographic Emulsion,* pp. 69 to 160, (Focal Press, 1964). Particularly, any of the acid process, the neutral process, the ammonia process, and the like may be used in the present invention. The reaction of the soluble silver salt with the soluble halogen salt can be accomplished by the single jet process, the double jet process, or a combination thereof.

Alternatively, the preparation of the photographic emulsion for use in the present invention can be accomplished by formation of silver halide grains in the presence of excess silver ions (a "reversal mixing" process). One form of the double jet process is a controlled double jet process which requires keeping constant the pAg of the liquid phase in which the silver halide grains are formed.

This process permits the formation of an emulsion of silver halide grains having a regular crystal form and a nearly uniform grain size.

Two different silver halide emulsions which have been separately prepared may be mixed to obtain a desired silver halide emulsion.

As a suitable silver halide emulsion for the present invention there may be used an emulsion of silver halide grains having crystal planes defined by a mirror index (nnl)(wherein n represents a natural number of 2 or less) on the outer surface as described in Kokai Giho No. 86-9598.

Alternatively, there may be used an emulsion of silver halide grains having a hollow passage extending from the surface to the interior thereof as described in JP-A-No. 61-75337. Such an emulsion of silver halide grains having a large specific area can provide a higher sensitivity than an emulsion of silver halide grains having the same volume particularly when color-sensitized. Therefore, such an emulsion can be more effectively used in the present invention.

Alternatively, a composite grain obtained by the epitaxial growth on a host grain of a silver salt having a different composition as described in JP-A-No. 58-108526 (corresponding to U.S. Pat. No. 4,435,501), and No. 59-162540 (corresponding to U.S. Pat. No. 4,463,087) may be preferably used in the present invention. Such a grain can exhibit a high sensitivity and high contrast and therefore can be preferably used in the present invention.

Furthermore, an emulsion of silver halide grains obtained by growth in the presence of tetrazaindene (as described in JP-A-No. 61-14630 and No. 60-122935 (corresponding to U.S. Pat. No. 4,610,958)) has a high silver iodide content and is excellent in monodispersibility, providing high sensitivity and excellent graininess. Such an emulsion can be preferably used in the present invention.

Moreover, a silver halide emulsion which has been subjected to gold sulfur sensitization or gold selenium sensitization in the presence of a nitrogen-containing heterocyclic compound as described in JP-A-No. 58-126526 exhibits less fog and high sensitivity. Such an emulsion can be preferably used in the present invention.

Alternatively, an emulsion of silver halide grains in a slightly rounded cubic or tetradecahedral crystal form (as described in JP-A-No. 59-149345 and JP-A-No. 59-149344 can provide high sensitivity and therefore may be preferably used in the present invention.

In the process of formation or physical ripening of silver halide grains, a cadmium salt, zinc salt, lead salt, thallium salt, iridium salt, or complex salt thereof, rhodium salt or complex salt thereof, or iron salt or complex salt thereof may be present.

Particularly, an emulsion of silver halide grains which have been formed in the presence of iridium has a high sensitivity (as described in JP-B-Nos. 43-4935, and 45-32738 and can therefore be preferably used in the present invention.

In the process of formation of the emulsion for use in the present invention, soluble salts are normally removed after precipitation or physical ripening. To this, end, there may be used a noodle rinse process, which has long been known. In this process, gelatin is gelated. Alternatively, a flocculation process may be used which utilizes an inorganic salt containing polyvalent anions such as sodium sulfate, an anionic surface active agent, and an anionic polymer (e.g., polystyrenesulfonic acid), or a gelatin derivative (e.g., aliphatic acylated gelatin, aromatic acylated gelatin, and aromatic carbamoylated gelatin).

The silver halide emulsion for use in the present invention is normally subjected to chemical sensitization. The chemical sensitization can be accomplished by any suitable method as described in H. Frieser, *Die Grundlagen der Photographischen Prozesse mit Silber-halogeniden* (Adakemische Verlagsgesellchaft, 1968), pp. 675–734.

Particularly, a sulfur sensitization process using a sulfur-containing compound capable of reacting with active gelatin or silver (e.g., a thiosulfate, thiourea, mercapto compound, rhodanine); a reduction sensitization process using a reducing substance (e.g., a stannous salt, amine, hydrazine derivative, formamidinesulfinic acid, silane compound); and a noble metal sensitization process using a noble metal compound (e.g., gold complex, and complex salts of the group VIII metals such as Pt, Ir, and Pd) may be used singly or in combination.

The photographic emulsion to be used in the present invention may be optionally subjected to spectral sensitization with a methine dye or other dyes. Examples of such dyes include a cyanine dye, merocyanine dye, composite cyanine dye, composite merocyanine dye, holopolar cyanine dye, hemicyanine dye, styryl dye and hemioxonol dye. Particularly preferred among these dyes are a cyanine dye, merocyanine dye, and composite merocyanine dye. Any nucleus which is used as a basic heterocyclic nucleus in cyanine dyes may be present in these dyes. Examples of such nuclei include a pyrroline nucleus, oxazoline nucleus, thiazoline nucleus, pyrrole nucleus, oxazole nucleus, thiazole nucleus, selenazole nucleus, imidazole nucleus, tetrazole nucleus, and pyridine nucleus. Other examples of such nuclei include those obtained by fusion of alicyclic hydrocarbon rings to the above described nuclei and those obtained by fusion of aromatic hydrocarbon rings to the above described nuclei, such as indolenine, benzindolenine, indole, benzoxadole, naphthooxazole, benzothiazole, naphthothiazole, benzoselenazole, benzimidazole, and quinoline. These nuclei may be substituted with substituent(s) on a carbon atom.

A nucleus having a ketomethylene structure may be present in a merocyanine dye or composite merocyanine dye. Examples of such a nucleus include five- or six-membered heterocyclic nuclei such as pyrazoline-5-one, thiohydantoin, 2-thiooxazolidine-2,4-dione, thiazolidine-2,4-dione, rhodanine, and thiobarbituric acid.

Useful sensitizing dyes include those described in German Patent No. 929,080, U.S. Pat. Nos. 2,231,658, 2,493,748, 2,503,776, 2,519,001, 2,912,329, 3,656,959, 3,672,897, 3,694,217, 4,025,349, and 4,046,572, British Patent No. 1,242,588, and JP-B-No. 44-14030, and JP-B-No. 52-24844 (corresponding to U.S. Pat. No. 3,982,950).

These sensitizing dyes may be used singly or in combination. Such a combination of sensitizing dyes may be used particularly for the purpose of supersensitization. Typical examples of such combinations are described in U.S. Pat. Nos. 2,688,545, 2,977,299, 3,397,060, 3,522,052, 3,527,641, 3,617,293, 3,628,964, 3,666,480, 3,672,898, 3,679,428, 3,703,377, 3,769,301, 3,814,609, 3,837,862, and 4,026,707, British Patent Nos. 1,344,281, and 1,507,803, JP-B-Mo. 43-4936 and JP-B-No. 53-12375, and JP-A-No. 52-110618 (corresponding to U.S. Pat. No. 4,152,163) and JP-A-No. 52-109925.

The emulsion for use in the present invention may contain a dye without an effect of spectral sensitization itself or a substance which does not substantially absorb visible light but exhibits an supersensitizing effect, together with a sensitizing dye. Examples of such a dye or substance include aminostyryl compounds substituted by nitrogen-containing heterocyclic groups as described in U.S. Pat. Nos. 2,933,390, and 3,635,721; aromatic organic acid-formaldehyde condensates as described in U.S. Pat. No. 3,743,510; cadmium salts; and azaindene compounds. Particularly, the combinations described in U.S. Pat. Nos. 3,615,613, 3,615,641, 3,617,295, and 3,635,721 are useful.

The silver halide emulsion to be used in the color negative photographic light-sensitive material having a photographic sensitivity of 320 to less than 800 according to the present invention is spectrally sensitized as described above to increase the sensitivity to visible light in a predetermined wavelength range. In order to minimize the deterioration of properties due to natural radiation, the sensitivity of the silver halide emulsion to natural radiation is preferably low. The sensitivity of a silver halide emulsion to natural radiation exhibits a good relationship with the inherent sensitivity but is not necessarily correlated with the color sensitization sensitivity. Therefore, in order to minimize the deterioration of properties due to natural radiation while keeping the sensitivity to light high, the color sensitization sensitivity is preferably high while the inherent sensitivity is preferably low. To this end, the above described supersensitizing agent may be particularly preferably used to increase only the color sensitization sensitivity without changing the inherent sensitivity. Alternatively, the sensitizing dye may be used in an amount as high as possible without reducing the color sensitization sensitivity too much so that the inherent sensitivity is reduced by inherent desensitization. Furthermore, tabular silver halide grains having an aspect ratio of 5 or more which provide a high efficiency of color sensitization by a sensitizing dye may be preferably used.

The preparation of such tabular silver halide grains can be easily accomplished by any suitable method as described in Gutoff, *Photographic Science and Engineering,* Vol 14, pp. 248–257, (1970); U.S. Pat. Nos. 4,434,226, 4,414,310, 4,433,048, and 4,439,520, and British Patent No. 2,112,157.

In the present invention, a silver halide emulsion supersensitized with a compound represented by formula (I) (described in JP-A-62-89952) may be preferably used.

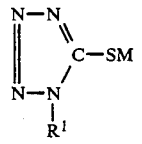

(I)

wherein $R^1$ represents an aliphatic, aromatic or heterocyclic group substituted by at least one —COOM or —$SO_3M$ group, in which M represents hydrogen, an alkali metal, quaternary ammonium or quaternary phosphonium, which has at most 30 carbon atoms is all.

Specific examples of preferred compounds represented by formula (I) which can be used in the present invention are shown below, but the present invention is not to be construed as being limited thereto.

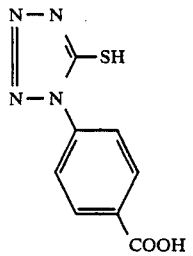

(1)

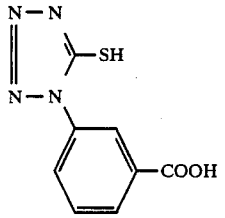

(2)

-continued
(3)
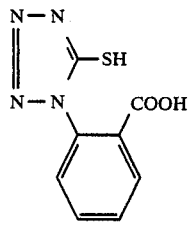
(4)
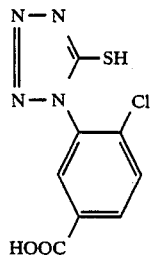
(5)
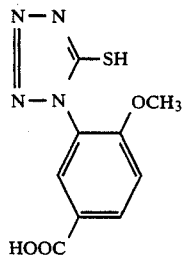
(6)
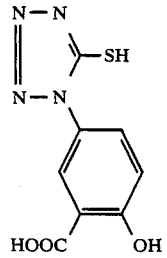
(7)
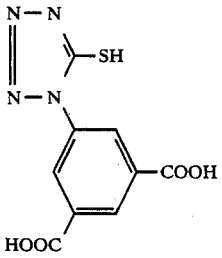
(8)
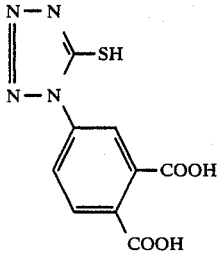
-continued
(9)
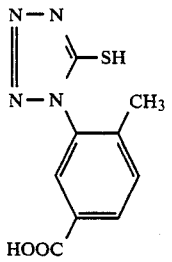
(10)
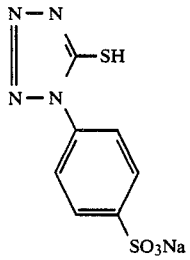
(11)
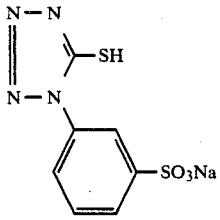
(12)
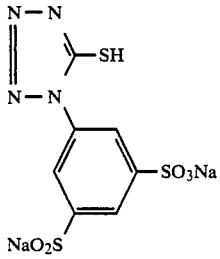
(13)
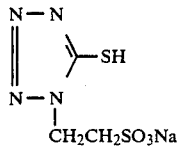
(14)
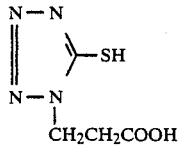
(15)
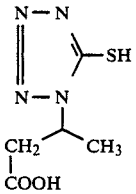
Among the preferred compounds represented by formula (I) as described above, compounds (1) and (10) are further preferred.

The compound represented by formula (I) is used in an amount of from $1\times10^{-5}$ to $1\times10^{-2}$ mol, preferably from $1\times10^{-4}$ to $1\times10^{-3}$ mol, per mol of silver halide.

The photographic emulsion layer used in the present invention may contain a color coupler incorporated therein as a dye image-forming substance.

Examples of such a color coupler include magenta couplers such as 5-pyrazolone couplers, pyrazolobenzimidazole couplers, cyanoacetylcoumarone couplers and open-chain acylacetonitrile couplers; yellow couplers such as acylacetamide couplers (e.g., benzoylacetanilide, pivaloylacetanilide); and cyan couplers such as naphthol couplers and phenol couplers. Specific examples of the magenta couplers include those described in U.S. Pat. Nos. 2,600,788, 2,983,608, 3,062,653, 3,127,269, 3,311,476, 3,419,391, 3,519,429, 3,558,319, 3,582,322, 3,615,506, 3,834,908 and 3,891,445, West German Patent No. 1,810,464, West German Patent Application (OLS) Nos. 2,408,665, 2,417,945, 2,418,959 and 2,424,467, JP-B-No. 40-6031, JP-A-No. 51-20826 (corresponding to U.S. Pat. No. 4,241,168), JP-A-No. 52-58922 (corresponding to U.S. Pat. No. 4,076,533), JP-A-No. 49-129538 (corresponding to U.S. Pat. No. 3,926,631), JP-A-No. 49-74027 (corresponding to U.S. Pat. No. 3,907,571), JP-A-No. 50-159336 (corresponding to U.S. Pat. No. 4,237,217), JP-A-No. 52-42121, JP-A-No. 49-74028 (corresponding to U.S. Pat. No. 3,928,044), JP-A-No. 50-60233 (corresponding to U.S. Pat. No. 3,960,571), JP-A-No. 51-26541 and JP-A-No. 53-55122 (corresponding to U.S. Pat. No. 4,133,686). Specific examples of the yellow couplers include those described in U.S. Pat. Nos. 2,875,057, 3,265,506 3,408,194, 3,551,155, 3,582,322, 3,725,072, and 3,891,445, West German Patent No. 1,547,868, West German Patent Application (OLS) Nos. 2,219,917, 2,261,361 and 2,414,006, British Patent No. 1,425,020, JP-B-No. 51-10783 (corresponding to U.S. Pat. No. 3,973,968), JP-A-No. 47-26133 (corresponding to U.S. Pat. No. 4,404,274), JP-A-No. 48-73147 (corresponding to U.S. Pat. No. 4,269,936), JP-A-No. 51-102636 (corresponding to U.S. Pat. No. 4,022,620), JP-A-No. 0-6341 (corresponding to U.S. Pat. No. 4,012,259), JP-A-No. 50-123342 (corresponding to U.S. Pat. No. 3,994,967), JP-A-No. 50-130442 (corresponding to U.S. Pat. No. 4,106,942), JP-A-No. 51-21827 (corresponding to U.S. Pat. No. 4,029,508), JP-A-No. 50-87650 (corresponding to U.S. Pat. No. 3,933,501), JP-A-No. 52-82424 (corresponding to U.S. Pat. No. 4,095,984) and JP-A-No. 52-115219. Specific examples of the cyan couplers include those described in U.S. Pat. Nos. 2,369,929, 2,434,272, 2,474,293, 2,512,908, 2,895,826, 3,034,892, 3,311,476, 3,458,315, 3,476,563, 3,583,971, 3,591,383, 3,767,411 and 4,004,929, West German Patent Application (OLS) Nos. 2,414,830 and 2,454,329, JP-A-No. 48-59838, JP-A-No. 51-26034 (corresponding to U.S. Pat. No. 4,138,258), JP-B-No. 48-5055, JP-A-No. 51-146828, JP-A-No. 52-69624 (corresponding to U.S. Pat. No. 4,149,886) and JP-A-No. 52-90932 (corresponding to U.S. Pat. No. 4,146,396). These couplers are preferably nondiffusible. That is, these couplers preferably contain a hydrophobic group called a "ballast group" in the molecule. Alternatively, these couplers are preferably polmerized compounds. These couplers may be either two-equivalent or four-equivalent to silver ion. In order to decrease the silver content in the light-sensitive material, a two-equivalent coupler which enables a higher efficiency of silver use is preferably used. Particularly, if emulsion layers each is formed of two or more emulsion layers having the same color sensitivity but different sensitivities, the emulsion layer having the highest sensitivity in each of the red-sensitive layer, green-sensitive layer and blue-sensitive layer may preferably contains such a two-equivalent coupler.

As suitable couplers for the present invention there may be used couplers having a high coupling reactivity, i.e., high speed reaction couplers as described in JP-A-No. 59-60437.

The coupling reactivity of a coupler can be determined by measuring the amount of the respective dyes in an image obtained by color development made when two kinds of couplers M and N, which give different dyes that can be distinctly separated from each other, are added to an emulsion in admixture.

Assuming that the coupler M exhibits the maximum density $(DM)_{max}$ and a density DM at the intermediate stage and the Coupler N exhibits the maximum density $(DN)_{max}$ and a density DN at the intermediate stage, the ratio of the reactivity of both the two couplers (RM/RN) can be given by the following equation:

$$\frac{RM}{RN} = \frac{\log\left(1 - \frac{DM}{(DM)_{max}}\right)}{\log\left(1 - \frac{DN}{(DN)_{max}}\right)}$$

That is, RM/RN can be obtained from the slope of a straight line obtained by plotting on a rectangular coordinate system log $$\left(1 - \frac{D}{D_{max}}\right)$$

of several sets of data of DM and DN given by the color development of an emulsion containing a mixture of the two couplers which has been exposed to light in various stages.

Using the coupler N as a fixed coupler, RM/RN can be determined for various couplers as described above to give a relative coupling reactivity. As the fixed coupler N there may be used the following couplers:

With respect to cyan couplers, the following coupler may be used:

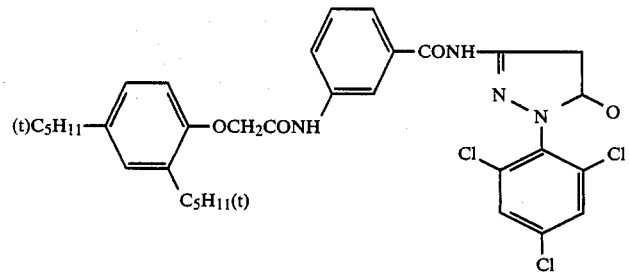

With respect to magenta or yellow couplers, the following coupler may be used:

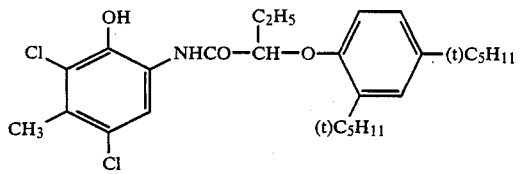

As the high speed reaction couplers for the present invention preferably cyan couplers, magenta couplers and yellow couplers are used having RM/RN values of 1.5 or more, 2.5 or more and more than 1, respectively, as determined with respect to the above described coupler N.

Specific examples of preferred high speed reaction couplers which can be used in the present invention are shown below, but the present invention is not to be construed as being limited thereto. The RM/RN valves for each are shown in parentheses.

Examples of cyan coupler (CYAN-1)

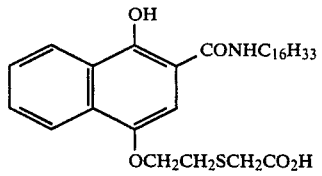

(2.9)

(CYAN-2)

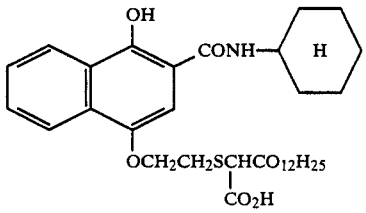

(2.8)

(CYAN-3)

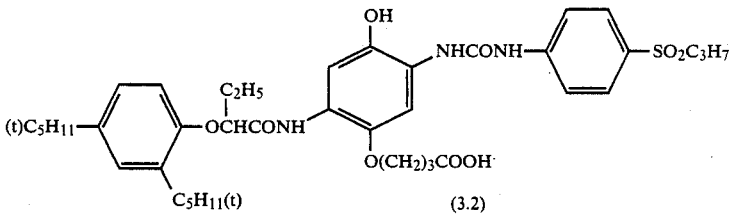

(3.2)

(CYAN-4)

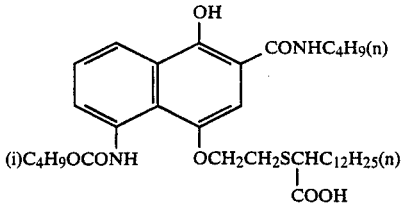

(2.9)

(CYAN-5)

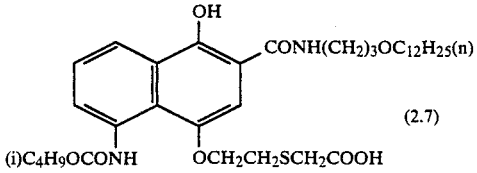

(2.7)

-continued
(CYAN-6)
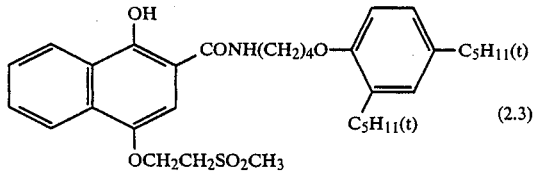
(2.3)
Examples of magenta coupler
(MAGENTA-1)
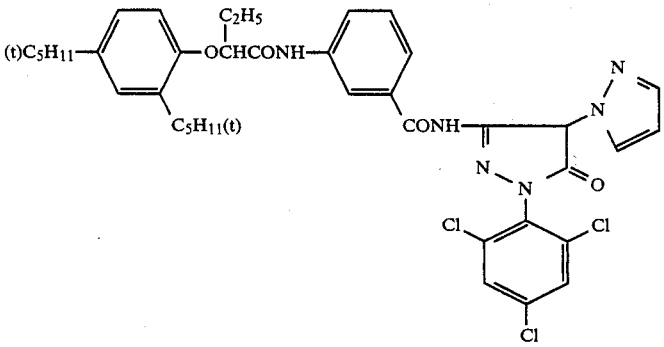
(8.2)
(MAGENTA-2)
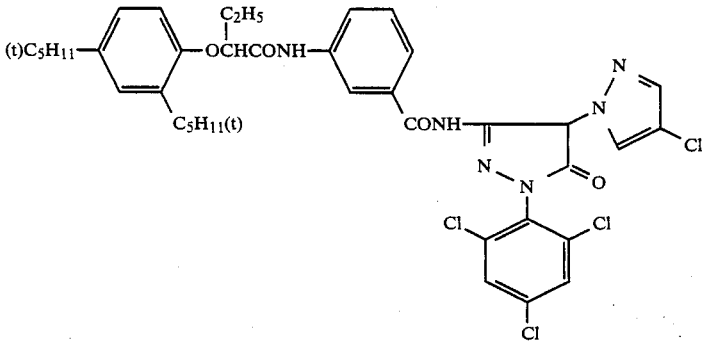
(14)
(MAGENTA-3)
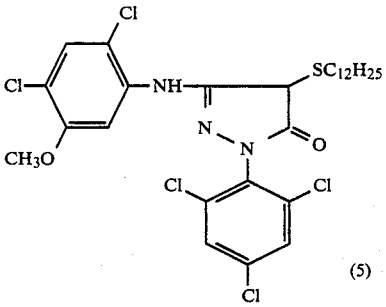
(5)

-continued
(MAGENTA-4)
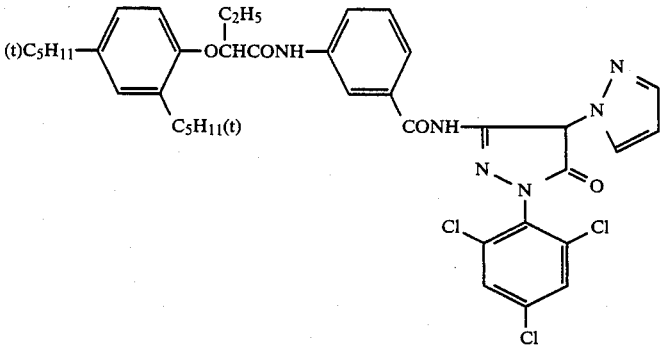
(7.4)
(MAGENTA-5)
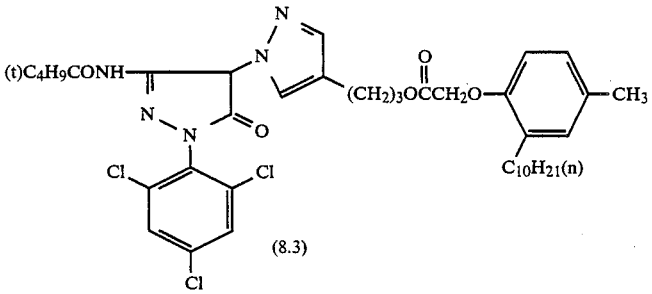
(8.3)
(MAGENTA-6)
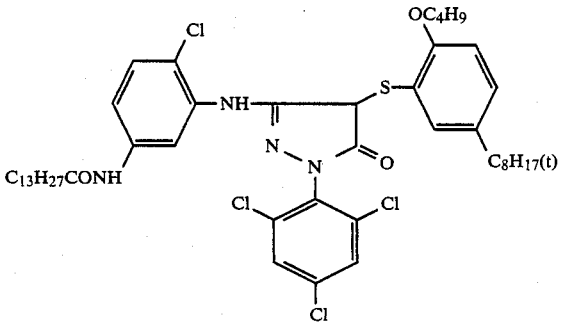
(7.5)
(MAGENTA-7)
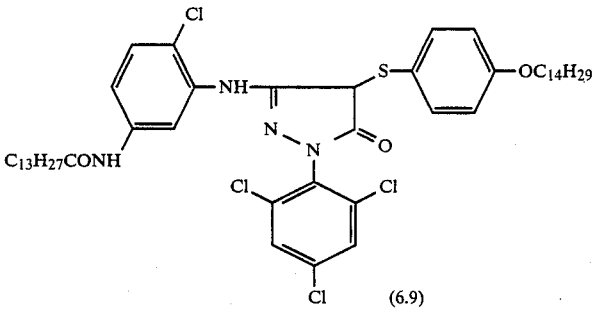
(6.9)
(MAGENTA-8)
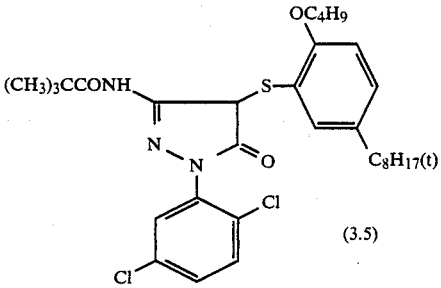
(3.5)

-continued
(MAGENTA-9)
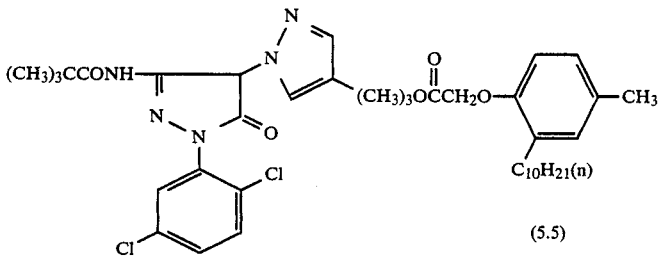
(5.5)
(MAGENTA-10)
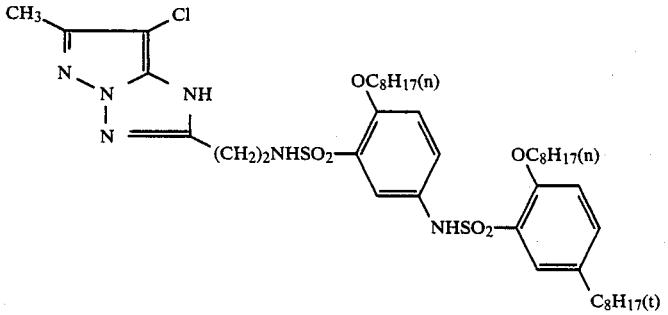
(6.7)
(MAGENTA-11)
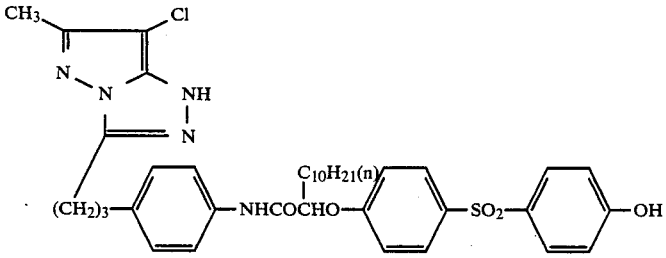
(5.9)
Examples of yellow coupler
(YELLOW-1)
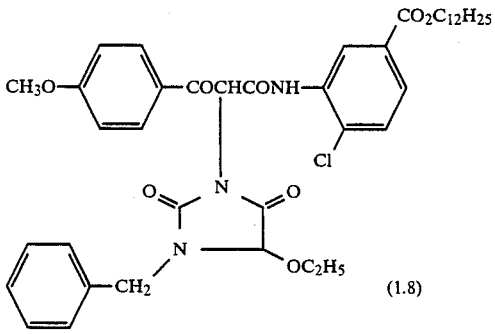
(1.8)
(YELLOW-2)
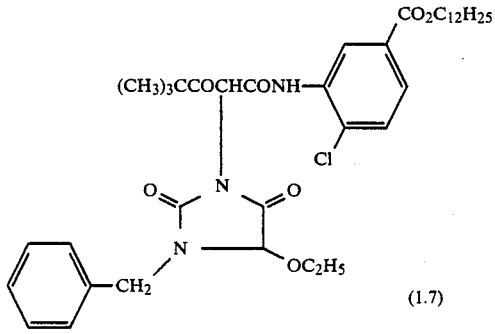
(1.7)

-continued

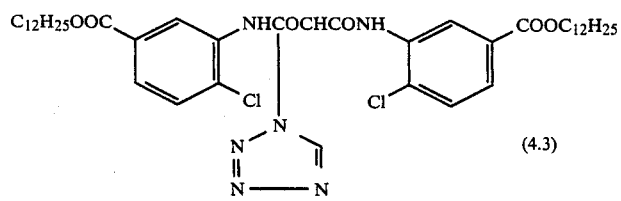

(4.3) (YELLOW-3)

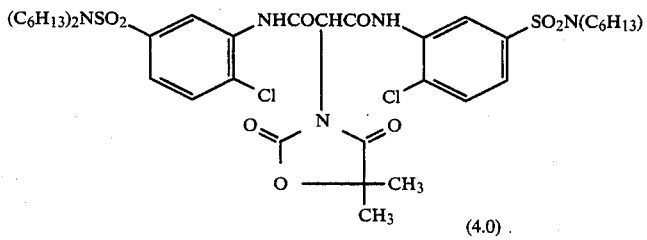

(4.0) (YELLOW-5)

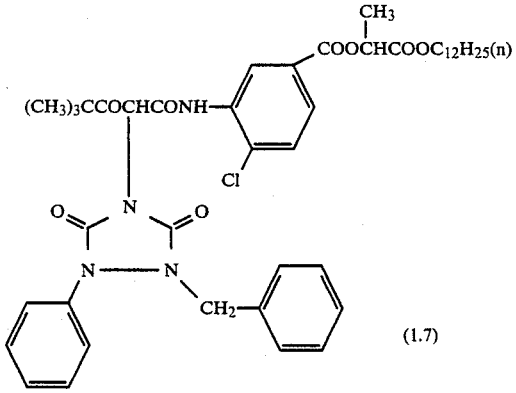

(1.7)

In the present invention, the high speed reaction couplers are preferably added at least in the emulsion layer units having the highest sensitivity in each of color-sensitive layers. The amount of the high speed reaction couplers used is not specifically limited, but the amount of the cyan high speed reaction coupler used is 0.005 to 0.1 mol per mol of silver, the amount of the magenta high speed reaction coupler used is 0.005 to 0.1 mol per mol of silver and the amount of the yellow high speed reaction coupler used is 0.005 to 0.1 mol per mol of silver.

Furthermore, in the present invention, a non-diffusible coupler capable of forming a dye having the appropriate diffusibility as described in Items 1 and 3 to 8 in U.S. Pat. No. 4,420,556 and JP-A-No. 59-191036 (corresponding to U.S. Pat. No. 4,729,944) may be used. The use of the coupler can provide an increased sensitivity and an improved graininess by an improved covering power. The coupler can be easily synthesized according to the method as described in the above-mentioned patent, JP-A-No. 56-1938 (corresponding to U.S. Pat. No. 4,296,199), JP-B-No. 57-3934, JP-A-No. 53-105226, and U.S. Pat. No. 4,264,723.

Typical examples of the couplers are shown below, but the present invention is not to be construed as being limited thereto.

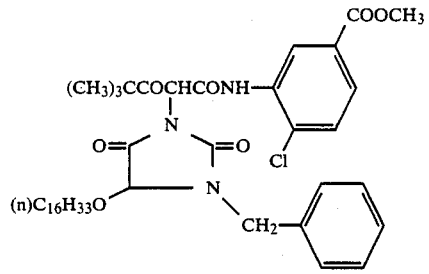

(Y-1)

-continued
(Y-2)
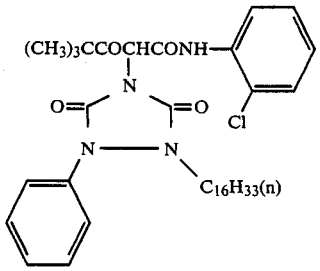
(Y-3)
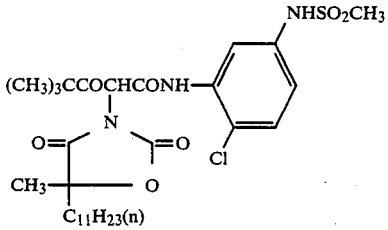
(Y-4)
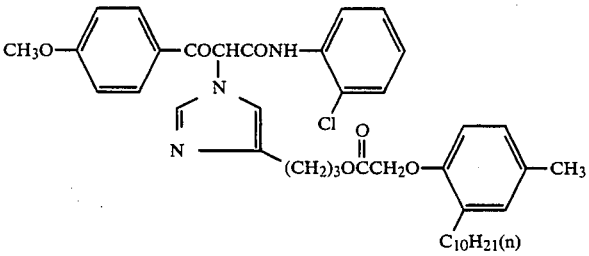
(Y-5)
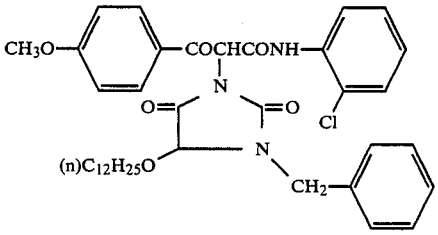
(Y-6)
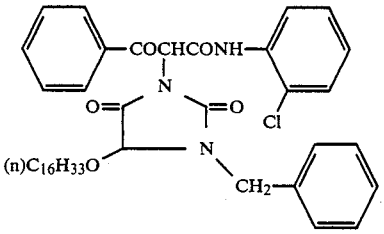
(Y-7)
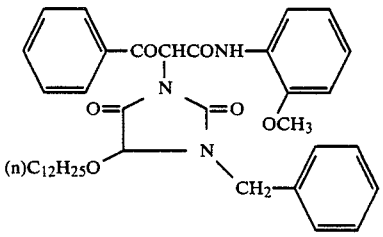

-continued
(M-1)
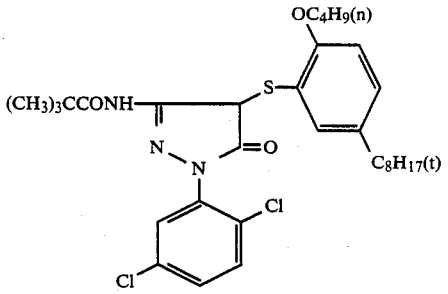
(M-2)
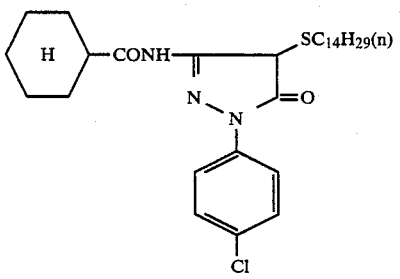
(M-3)
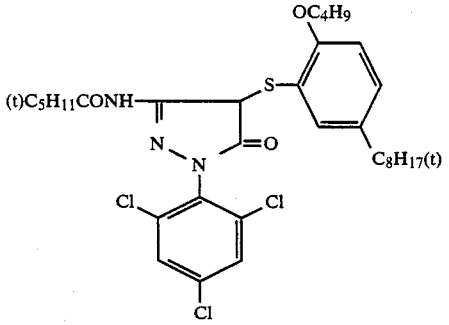
(M-4)
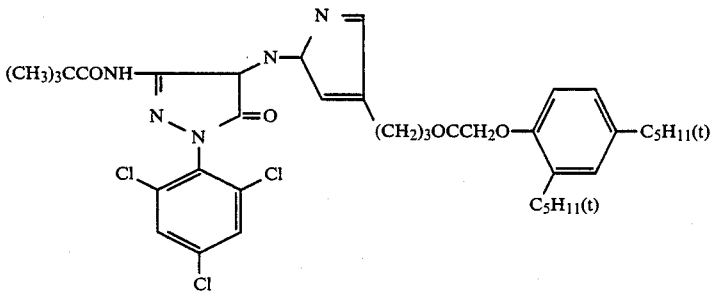
(C-1)
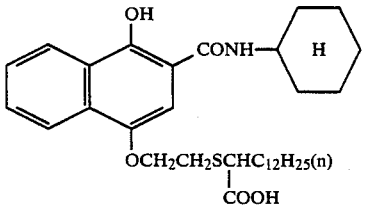
(C-2)
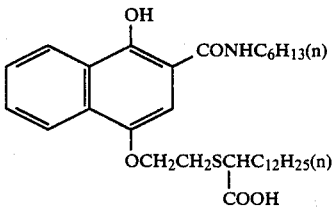

-continued

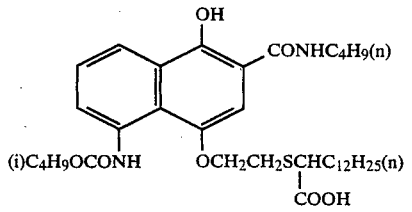

(C-3)

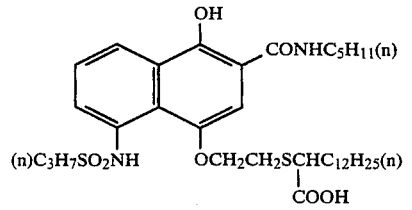

(C-4)

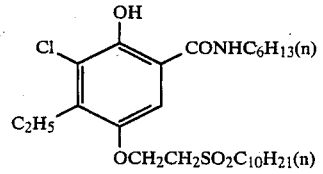

(C-5)

Besides the above described couplers, colored couplers having an effect of correcting color or couplers which release a development inhibitor upon development ("DIR" couplers) may be used in the present invention. Specific examples of the colored couplers include those described in U.S. Pat. Nos. 3,476,560, 2,521,908 and 3,034,892, JP-B-No. 44-2016, JP-B-No. 38-22335, JP-B-No. 42-11304 (corresponding to U.S. Pat. No. 3,481,741), JP-B-No. 44-32461 (corresponding to U.S. Pat. No. 3,583,971), JP-A-No. 51-26034 (corresponding to U.S. Pat. No. 4,138,258), JP-A-No. 52-42121, and West German Patent Application (OLS) No. 2,418,959.

Besides DIR couplers, colorless compound forming DIR coupling compounds which undergo a coupling reaction to give a colorless product and release a development inhibitor may be used in the present invention. Specific examples of the colorless compound forming DIR coupling compounds include those described in U.S. Pat. Nos. 3,227,554, 3,617,291, 3,701,783, 3,790,384 and 3,632,345, West German Patent Application (OLS) Nos. 2,414,006, 2,454,301 and 2,454,329, British Patent No. 953,454, JP-A-No. 52-69624 (corresponding to U.S. Pat. No. 4,149,886), JP-A-No. 49-122335 (corresponding to U.S. Pat. No. 3,933,500) and JP-B-No. 51-16141 (corresponding to U.S. Pat. No. 3,958,993).

In the present invention, a compound which can form a development accelerator or fogging agent upon silver development (hereinafter referred to as "FR compound") may be used to provide the desired high sensitivity. The synthesis of such a FR compound can be easily accomplished by any suitable method as described in U.S. Pat. Nos. 4,390,618, 4,518,682, 4,526,863, and 4,482,629, and JP-A-No. 59-157638 (corresponding to U.S. Pat. No. 4,734,357), JP-A-No. 59-170840, JP-A-No. 60-185950 (corresponding to U.S. Pat. No. 4,618,571) and JP-A-No. 60-107029 (corresponding to U.S. Pat. No. 4,724,199).

These FR compounds may be used singly or in combination. The added amount of such a FR compound is in the range of $10^{-10}$ to 0.2 mol, preferably $10^{-7}$ to 0.02 mol per 1 mol of silver contained in the same layer or adjacent layer. Such a FR compound can be incorporated in the silver halide emulsion layer singly or in combination with a dye image-forming coupler in an oil-in-water dispersion, known as an "oil protect process", to accomplish the desired objects.

Typical examples of FR compounds are shown below, but the present incention is not to be construed as being limited thereto.

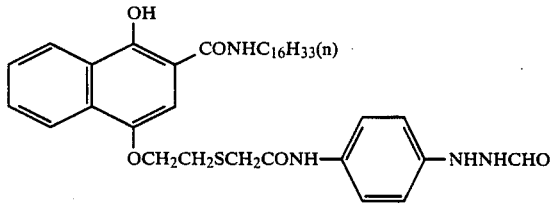

FR-1

-continued
FR-2
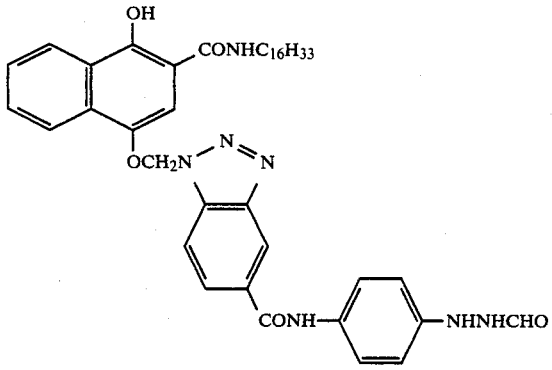
FR-3
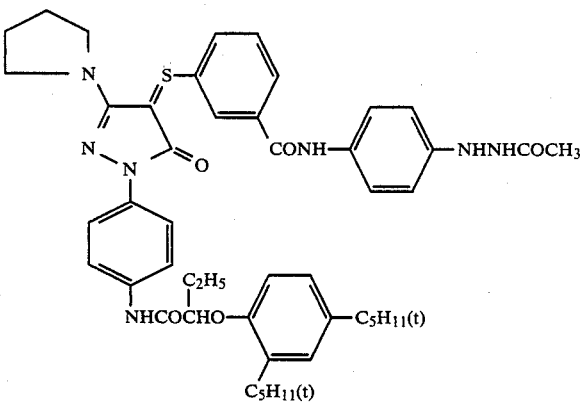
FR-4
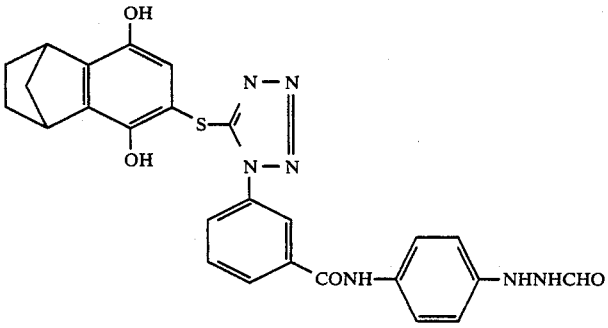
FR-5
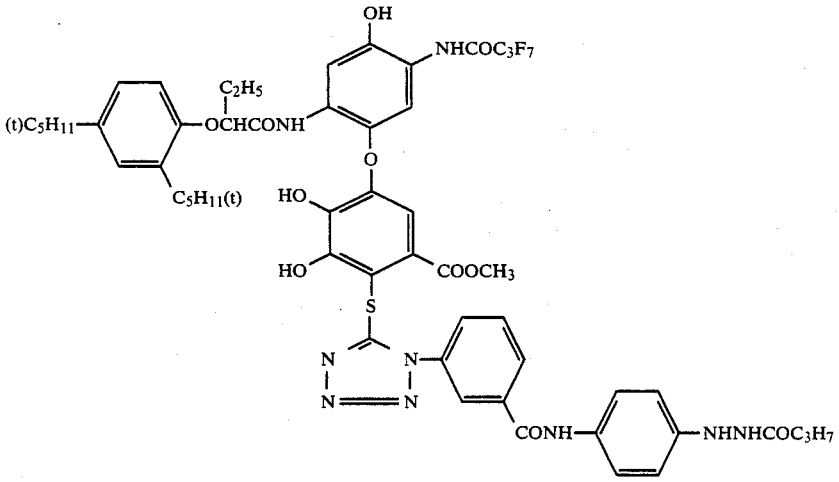

-continued
FR-6
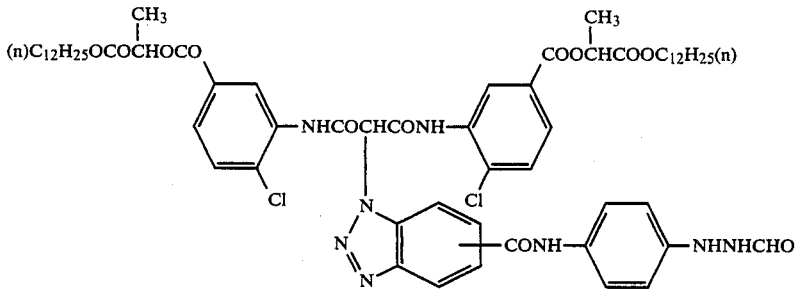
FR-7
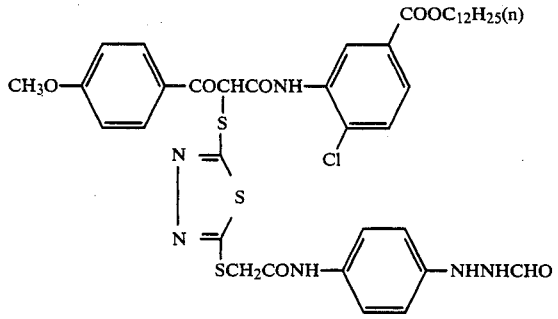
FR-8
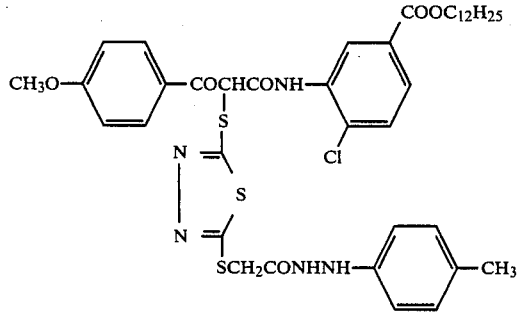
FR-9
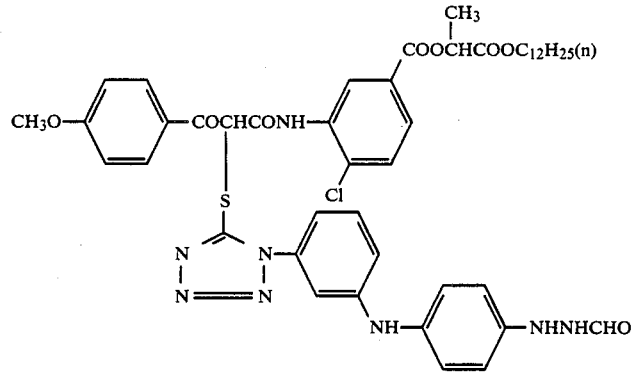

-continued
FR-10
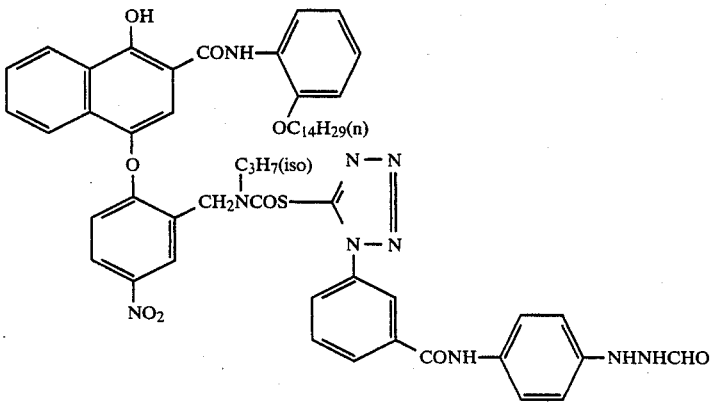
FR-11
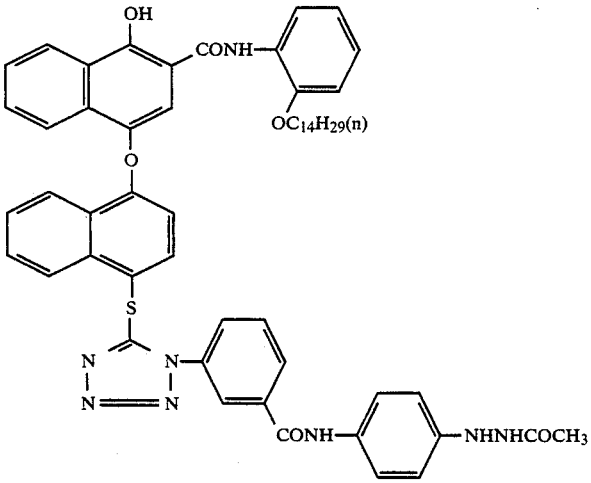
FR-12
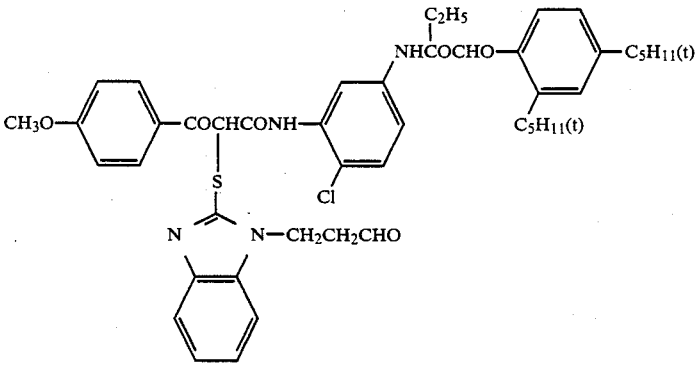
FR-13
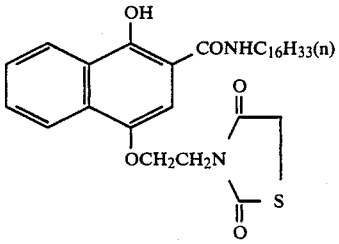

-continued
RF-14
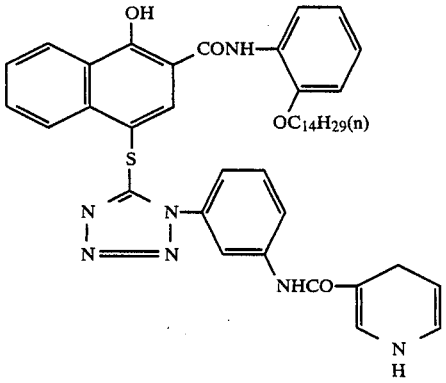
FR-15
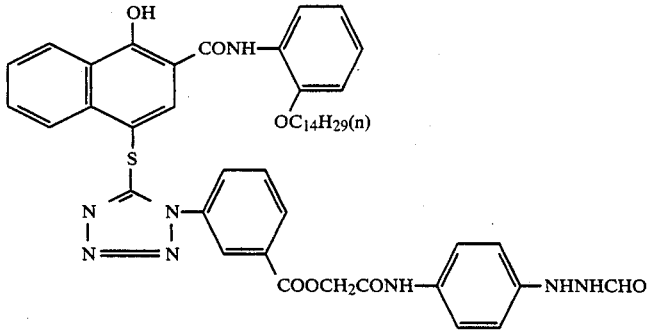
FR-16
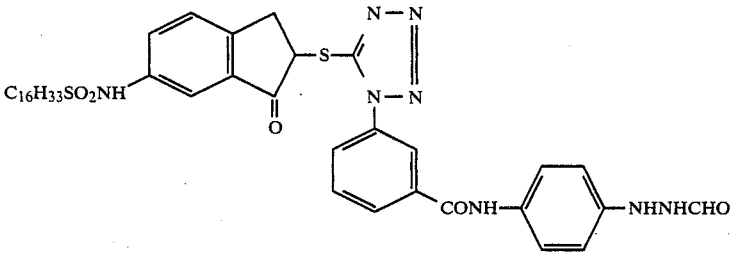
FR-17
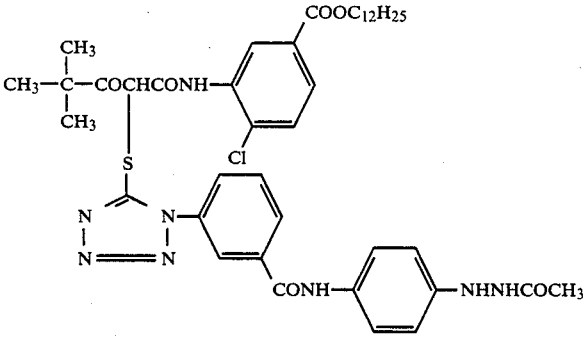

-continued
FR-18
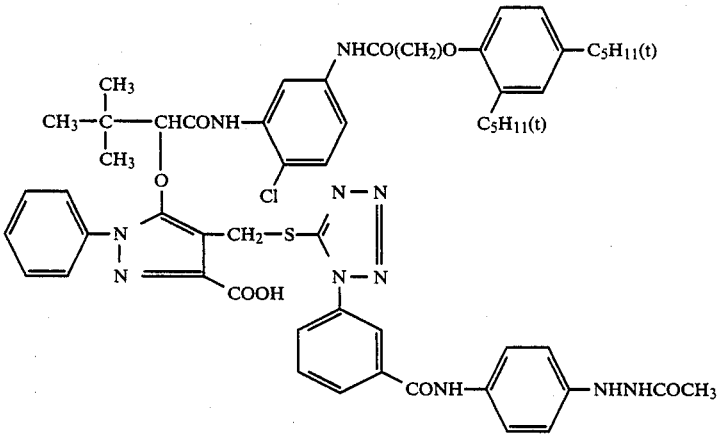
FR-19
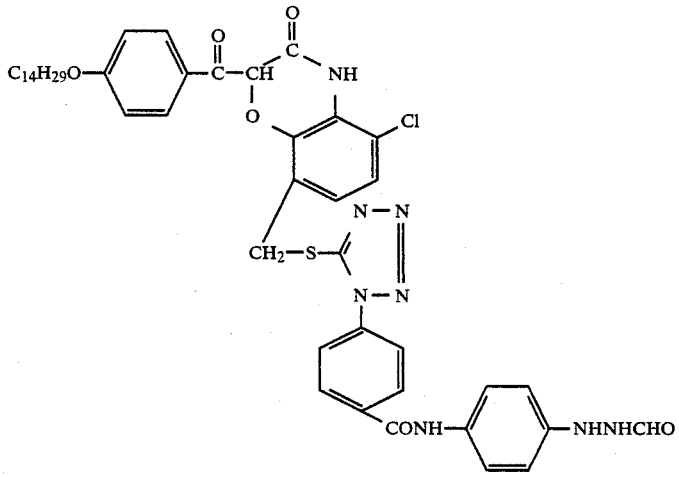
FR-20
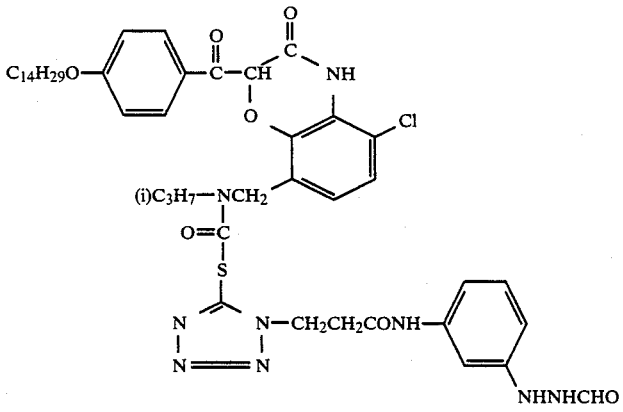

-continued

FR-21

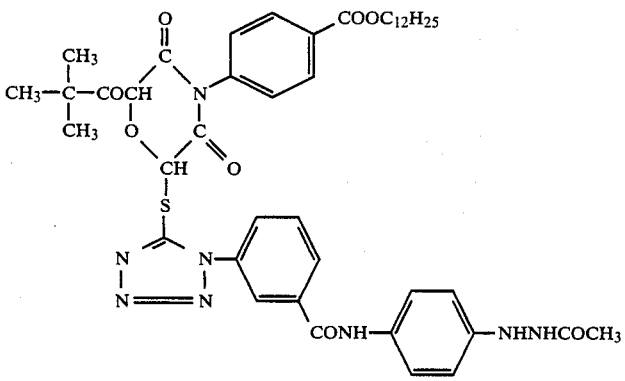

FR-22

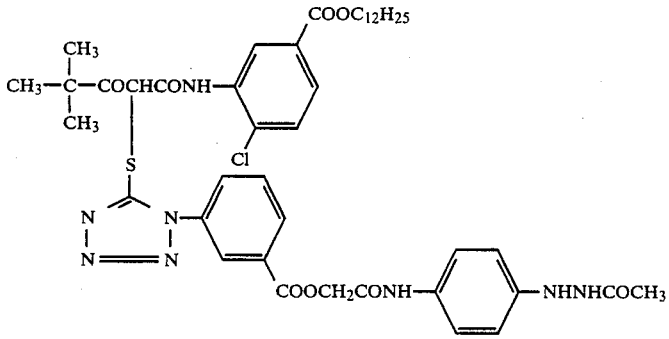

FR-23

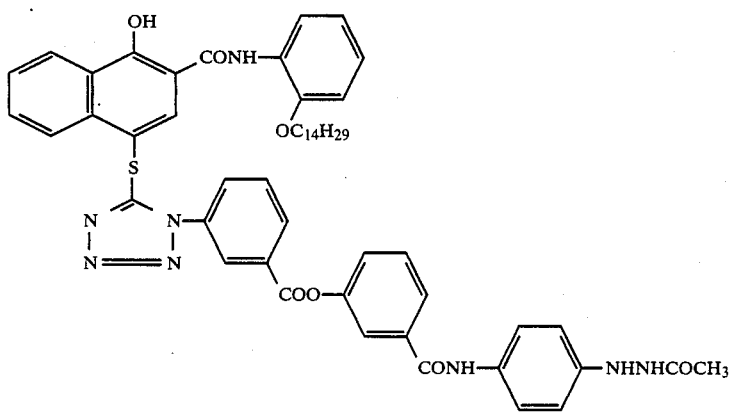

In Order to satisfy the properties required by the light-sensitive material, the above described couplers may be used in combination in the same layer or may be used singly in two or more layers.

The incorporation of the coupler in the silver halide emulsion layer can be accomplished by any known method as described in U.S. Pat. No. 2,322,027. The coupler may be dispersed in a hydrophilic colloid in the form of a solution in a phthalic alkyl ester (e.g., dibutyl phthalate, dioctyl phthalate), ester phosphate (e.g., diphenyl phosphate, triphenol phosphate, tricresyl phosphate, dioctyl butyl phosphate), ester citrate (e.g., tributyl acetylcitrate), ester benzoate (e.g., octyl benzoate), alkylamide (e.g., diethyllaurylamide), aliphatic ester (e.g., dibutylethyl succinate, diethyl azerate), ester trimesicate (e.g., tributyl trimesicate), or an organic solvent having a boiling point of about 30° to 150° C. such as a lower alkyl acetate (e.g., ethyl acetate, butyl acetate), ethyl propionate, secondary butyl alcohol, methyl isobutyl ketone, β-ethoxy ethyl acetate, and methylcellosolve acetate. These high boiling organic solvents and low boiling organic solvents may be used in admixture.

Alternatively, a dispersion process using a polymerization product as described in JP-B-No. 51-39853 and JP-A-No. 51-59943 (corresponding to U.S. Pat. No. 4,214,047) may be used in the present invention.

If the coupler to be incorporated in the emulsion contains an acid group such as a carboxylic acid or sulfonic acid group, it may be incorporated in the hydrophilic colloid in the form of an alkaline aqueous solution.

The photographic color coupler to be used may be advantageously selected so that it provides a medium scale image. The maximum absorption band of a cyan dye produced by the cyan coupler is preferably in the range of about 600 to 720 nm. The maximum absorption band of a magenta dye produced by the magenta coupler is preferably in the range of about 500 to 580 nm. The maximum absorption band of a yellow dye produced by the yellow coupler is preferably in the range of about 400 to 480 nm.

The present light-sensitive material may contain a filter dye in the hydrophilic colloid layer, preferably in the light-insensitive layer. Alternatively, the light-sensitive material of the present invention may comprise any suitable dye for the purpose of inhibiting irradiation or other various purposes. Examples of such dyes include an oxonol dye, hemixonol dye, styryl dye, merocyanine dye, cyanine dye and azo dye. Particularly useful among these dyes are oxonol dyes, hemioxonol dyes and merocyanine dyes. Specific examples of dyes which can be used in the present invention are described in British Patent Nos. 584,609, and 177,429, JP-A-No. 48-85130, JP-A-No. 49-114420, and JP-A-No. 52-108115 and U.S. Pat. Nos. 2,255,077, 2,274,782, 2,390,707, 2,493,747, 2,533,472, 2,843,486, 2,956,879, 3,148,187, 3,177,078, 3,247,127, 3,540,887, 3,575,704, 3,653,905, 3,718,472, 4,071,312, 4,070,352, and 4,420,555.

In the light-sensitive material of the present invention, if a dye or ultraviolet light absorber is contained in the hydrophilic colloid layer, it may be mordanted by a cationic polymer or the like. Examples of such a cationic polymer which can be used in the present invention include polymers as described in U.S. Pat. Nos. 685,475, 2,675,316, 2,839,401, 2,882,156, 3,048,487, 3,184,309, and 3,445,231, West German Patent Application (OLS) No. 1,914,362, and JP-A-No. 50-47624 (corresponding to U.S. Pat. No. 3,986,875), and JP-A-No. 50-71332 (corresponding to U.S. Pat. No. 4,124,386).

The color negative photographic light-sensitive material of the present invention normally has a yellow filter layer. Such a yellow filter layer contains colloidal silver or various dyes described below. Particularly, such dyes exhibit an excellent filter effect in the present invention. The sensitivity of the green-sensitive emulsion layer is remarkably higher when such dyes are used than when colloidal silver is used. A yellow filter dye represented by formula [II] described in JP-A-No. 63-40143 (the prior patent to the Applicant, filed on Aug. 5, 1986, "Silver Halide Photographic Material") may be preferably used.

[II]

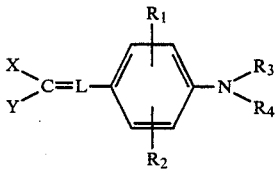

wherein X and Y, which may be the same or different, and each represents a cyano group, a carboxyl group, an alkylcarbonyl group, an arylcarbonyl group, an alkoxycarbonyl group, an aryloxycarbonyl group, a carbamoyl group, a sulfonyl group or a sulfamoyl group, provided that if either of X and Y represents a cyano group, the other represents a group other than a substituted or unsubstituted alkylcarbonyl group or a sulfonyl group; $R_1$ and $R_2$, which may be the same or different, each represents hydrogen, a halogen atom, an alkyl group, an alkoxy group, a hydroxyl group, a carboxyl group, a substituted amino group, a carbamoyl group, a sulfamoyl group or an alkoxycarbonyl group; $R_3$ and $R_4$, which may be the same or different, each represents hydrogen, an alkyl group or an aryl group, and $R_3$ and $R_4$ may be linked to form a five- or six-membered ring; $R_1$ and $R_3$ or $R_2$ and $R_4$ may be linked to form a five- or six-membered ring; and L, represents a methine group.

Specific examples of the yellow dye represented by the general formula [II] are shown below, but the present invention is not to be construed as being limited thereto.

YF-1

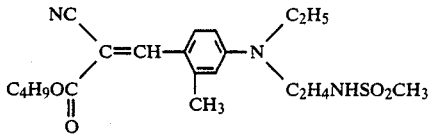

YF-2

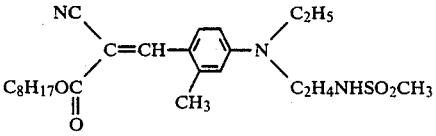

YF-3

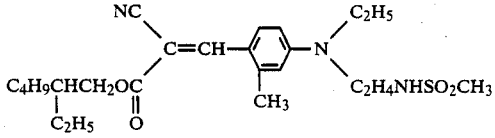

YF-4

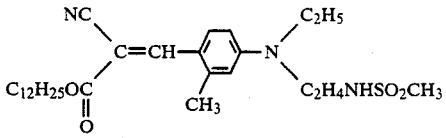

YF-5

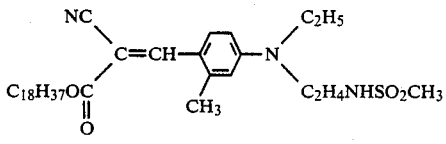

YF-6

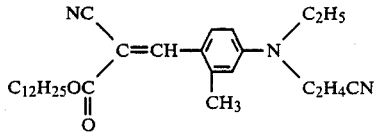

YF-7

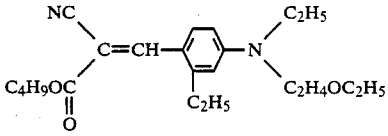

YF-8

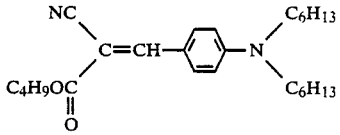

YF-9

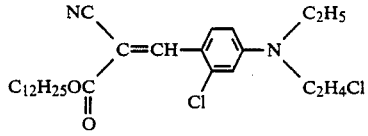

YF-10

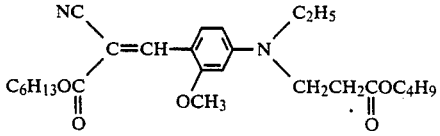

-continued

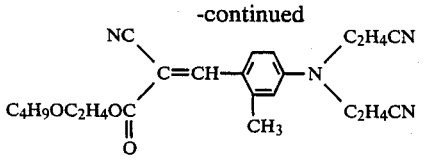

YF-11

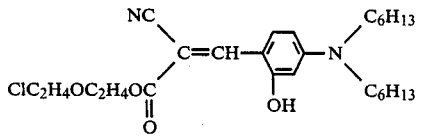

YF-12

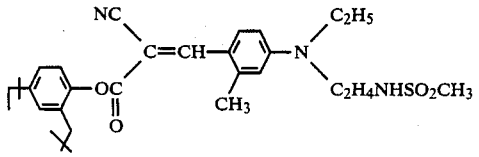

YF-13

The above described yellow dyes not only minimize the silver content by eliminating the need for yellow colloidal silver, but also provide a specific sensitizing effect. That is, these yellow dyes have sharp light absorption characteristics. They do not absorb but transmit light effective for the green-sensitive and red-sensitive silver halide layers. Therefore, these yellow dyes can be advantageously used to provide a high sensitivity to the underlayer. Furthermore, a physical phenomenon which can easily occur due to the continuity of colloidal silver can be avoided by such a yellow dye filter. Therefore, a high sensitive emulsion which has been fully after-ripened can be easily incorporated in the blue-sensitive and green-sensitive layers.

Once a high sensitive green-sensitive layer is obtained by the use of such a yellow dye, the sensitivity can be maintained even if the silver content thereof is reduced. Furthermore, if a two-equivalent coupler is incorporated in the green-sensitive a layer, particularly both a high sensitive layer and a low sensitive layer therein, the efficiency of formation of dye can be improved, resulting in the desired reduction of the silver content without deteriorating the graininess.

Furthermore, the reduction of the silver content in the green-sensitive layer leads to an improvement in the efficiency of use of light by the underlying redsensitive layer. Combined with the supersensitizing effect given by the use of the dye represented by formula (II), this further helps maintain the high sensitivity even if the silver content is reduced.

The yellow dye can be used in such an amount that the optical density becomes 0.05 to 3.0, as described in JP-A-No. 63-40143.

The light-sensitive material of the present invention may contain various additives which are commonly used in silver halide light-sensitive materials. Examples of such additives are described in U.S. Pat. No. 4,599,301. Typical examples of these additives are described from line 12 in the 33rd column to line 45 in the 38the column in the specification of the above-described patent. For example, these include surface active agents (33rd column), water-insoluble or sparingly-soluble polymers (33rd–34th columns), ultraviolet light absorbers (37th38th columns), color fog inhibitors (37th–38th columns), and hydroquinones (38 column).

The light-sensitive material of the present invention can be developed in accordance with any suitable method as described in U.S. Pat. No. 4,599,301 (34th column to 35th column). The stabilization or rinse process as described in JP-A-No. 61-35446 can be used to drastically reduce the amount of water used in the steps after the desilvering process.

The present invention will be further described hereinafter with reference to the following specific examples, but the present invention is not to be construed as being limited thereto. Unless otherwise indicated, all parts percents and ratios are by weight.

EXAMPLE 1

A multilayer color light-sensitive material specimen 101 was prepared by coating various layers having the following compositions on an undercoated cellulose triacetate film support.

Composition of light-sensitive layer

The coated amount of each component is represented in g/m$^2$, and the coated amount of silver halide is represented in terms of amount of silver. The coated amount of sensitizing dye is represented in terms of mol per 1 mol of silver halide incorporated in the same layer.

| Specimen 101 | |
|---|---|
| **1st layer: antihalation layer** | |
| Black colloidal silver (diameter: 0.1 μm) | 0.18 |
| Gelatin | 0.40 |
| **2nd layer: intermediate layer** | |
| Cpd-1 as described below | 0.18 |
| EX-1 | 0.07 |
| EX-3 | 0.02 |
| EX-12 | 0.002 |
| U-1 | 0.16 |
| U-2 | 0.08 |
| U-3 | 0.10 |
| HBS-1 | 0.10 |
| HBS-2 | 0.02 |
| Gelatin | 1.04 |
| **3rd layer: 1st red-sensitive emulsion layer** | |
| Monodisperse silver bromoiodide emulsion (silver iodide content 6 mol %; average grain diameter: 0.6 μm; coefficient of variation in grain diameter: 0.15) | 0.55 |
| Sensitizing dye I | $6.9 \times 10^{-5}$ |
| Sensitizing dye II | $1.8 \times 10^{-5}$ |
| Sensitizing dye III | $3.1 \times 10^{-4}$ |
| Sensitizing dye IV | $4.0 \times 10^{-5}$ |
| EX-2 | 0.350 |
| HBS-1 | 0.005 |
| EX-10 | 0.020 |
| Gelatin | 1.20 |
| **4th layer: 2nd red-sensitive emulsion layer** | |
| Emulsion of tabular silver bromoiodide grain (silver iodide content: 10 mol %; average grain diameter: 0.7 μm; average aspect ratio: 5.5; average thickness: 0.2 μm) | 1.0 |
| Sensitizing dye I | $5.1 \times 10^{-5}$ |
| Sensitizing dye II | $1.4 \times 10^{-5}$ |
| Sensitizing dye III | $2.3 \times 10^{-4}$ |
| Sensitizing dye IV | $3.0 \times 10^{-4}$ |
| EX-2 | 0.400 |
| EX-3 | 0.050 |
| EX-10 | 0.015 |
| Gelatin | 1.30 |
| **5th layer: 3rd red-sensitive emulsion layer** | |
| Silver bromoiodide emulsion (silver iodide content 6 mol %; average grain diameter: 1.1 μm) | 1.60 |
| Sensitizing dye IX | $5.4 \times 10^{-5}$ |
| Sensitizing dye II | $1.4 \times 10^{-5}$ |
| Sensitizing dye III | $2.4 \times 10^{-4}$ |
| Sensitizing dye IV | $3.1 \times 10^{-5}$ |
| EX-3 | 0.240 |
| EX-4 | 0.120 |
| HBS-1 | 0.22 |
| HBS-2 | 0.10 |
| Gelatin | 1.63 |

-continued

| Specimen 101 | |
|---|---|
| 6th layer: intermediate layer | |
| EX-5 | 0.040 |
| HBS-1 | 0.020 |
| Gelatin | 0.80 |
| 7th layer: 1st green-sensitive emulsion layer | |
| Emulsion of tabular silver bromoiodide grain (silver iodide content: 6 mol %; average grain diameter 0.6 μm; average aspect ratio: 6.0; average thickness 0.15) | 0.40 |
| Sensitizing dye V | $3.0 \times 10^{-5}$ |
| Sensitizing dye X | $1.0 \times 10^{-4}$ |
| Sensitizing dye VII | $3.8 \times 10^{-4}$ |
| EX-6 | 0.260 |
| EX-1 | 0.021 |
| EX-7 | 0.030 |
| EX-8 | 0.025 |
| HBS-1 | 0.100 |
| HBS-4 | 0.010 |
| Gelatin | 0.75 |
| 8th layer: 2nd green-sensitive emulsion layer | |
| Monodisperse silver bromoiodide emulsion (silver iodide content: 9 mol %; average grain diameter: 0.7 μm; coefficient of variation in grain diameter: 0.18) | 0.80 |
| Sensitizing dye V | $2.1 \times 10^{-5}$ |
| Sensitizing dye VI | $7.0 \times 10^{-5}$$ |
| Sensitizing dye VII | $2.6 \times 10^{-4}$ |
| EX-6 | 0.180 |
| EX-8 | 0.010 |
| EX-1 | 0.008 |
| EX-7 | 0.012 |
| HBS-1 | 0.160 |
| HBS-4 | 0.008 |
| Gelatin | 1.10 |
| 9th layer: 3rd green-sensitive emulsion layer | |
| Silver bromoiodide emulsion (silver iodide content: 12 mol %; average grain.diameter: 1.0 μm) | 1.2 |
| Sensitizing dye V | $3.5 \times 10^{-5}$ |
| Sensitizing dye VI | $8.0 \times 10^{-5}$ |
| Sensitizing dye VII | $3.0 \times 10^{-4}$ |
| EX-6 | 0.065 |
| EX-11 | 0.030 |
| EX-1 | 0.025 |
| HBS-1 | 0.25 |
| HBS-2 | 0.10 |
| Gelatin | 1.74 |
| 10th layer: yellow filter layer | |
| Yellow colloidal silver (diameter: 0.1 μm) | 0.05 |
| EX-5 | 0.08 |
| HBS-3 | 0.03 |
| Gelatin | 0.95 |
| 11th layer: 1st blue-sensitive emulsion layer | |
| Emulsion of tabular silver bromoiodide grain (silver iodide content: 6 mol %; average grain diameter: 0.6 μm; average aspect ratio: 5.7; average thickness: 0.15) | 0.24 |
| Sensitizing dye VIII | $3.5 \times 10^{-4}$ |
| EX-9 | 0.85 |
| EX-8 | 0.12 |
| HBS-1 | 0.28 |
| Gelatin | 1.28 |
| 12th layer: 2nd blue-sensitive emulsion layer | |
| Monodisperse silver bromoiodide emulsion (silver iodide content: 10 mol %; average grain diameter: 0.8 μm; coefficient of variation in grain diameter: 0.16) | 0.45 |
| Sensitizing dye VIII | $2.1 \times 10^{-4}$ |
| EX-9 | 0.20 |
| EX-10 | 0.015 |
| HBS-1 | 0.03 |
| Gelatin | 0.46 |
| 13th layer: 3rd blue-sensitive emulsion layer | |
| Silver bromoiodide emulsion (silver iodide content 14 mol %; average grain diameter: 1.3 μm) | 0.77 |
| Sensitizing dye VIII | $2.2 \times 10^{-4}$ |
| EX-9 | 0.20 |
| HBS-1 | 0.07 |
| Gelatin | 0.69 |
| 14th layer: 1st protective layer | |
| Silver bromoiodide emulsion (silver iodide content: 1 mol %; average grain diameter: 0.07 μm) | 0.5 |
| U-4 | 0.11 |
| U-5 | 0.17 |
| HBS-1 | 0.90 |
| Gelatin | 1.00 |
| 15th layer: 2nd protective layer | |
| Polymethyl acrylate grain (diameter: approx. 1.5 μm) | 0.54 |
| S-1 | 0.15 |
| S-2 | 0.05 |
| Gelatin | 0.72 |

Besides the above described components, a gelatin hardener H-1 and 0.01 to 0.03 g/m$^2$ of a surface active agent were added to each layer.

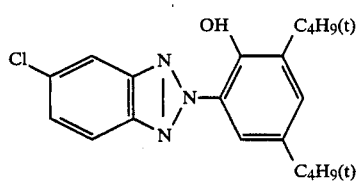

U-1

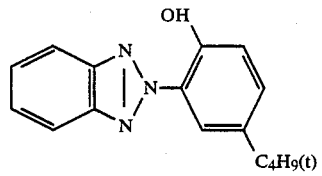

U-2

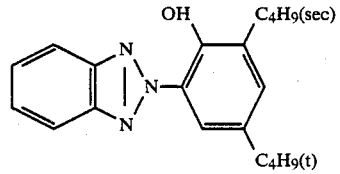

U-3

-continued
U-4
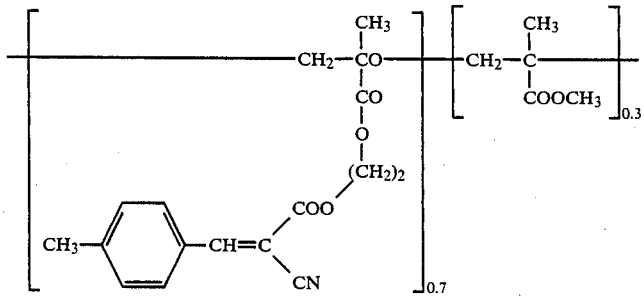
U-5
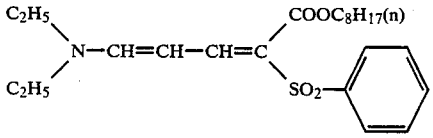
EX-1
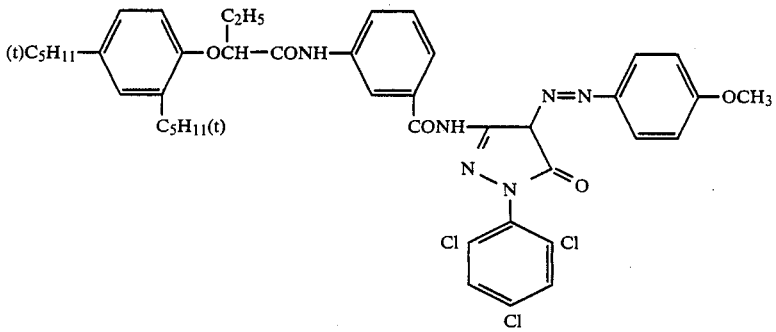
EX-2
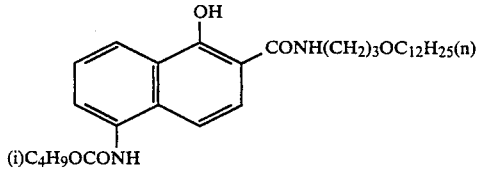
EX-3
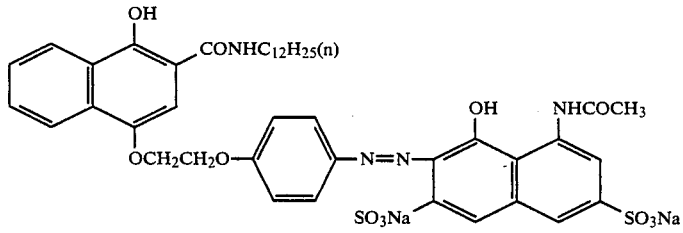
EX-4
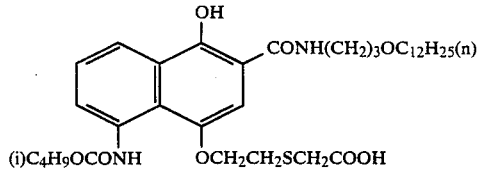
EX-5
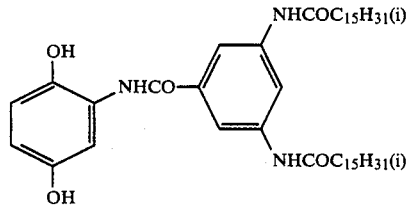

-continued
EX-6
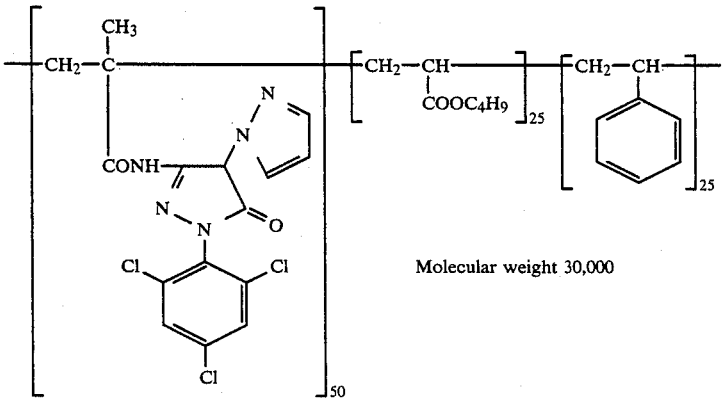
Molecular weight 30,000
EX-7
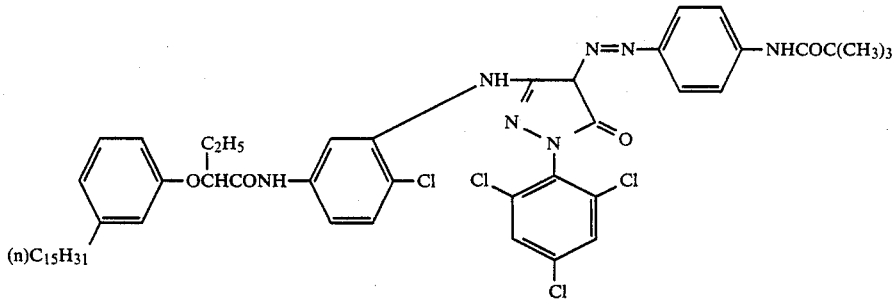
EX-8
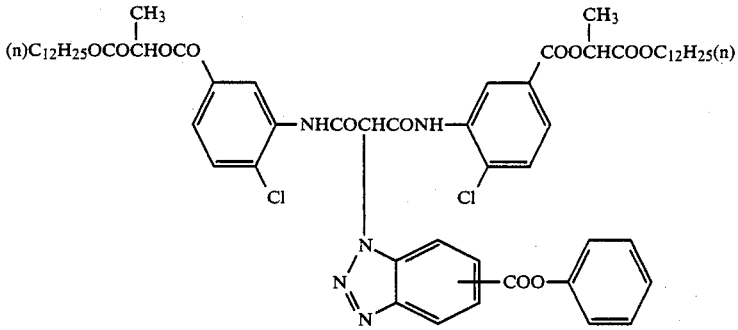
EX-9
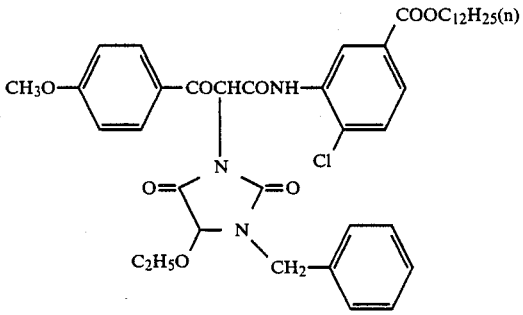

-continued
EX-10
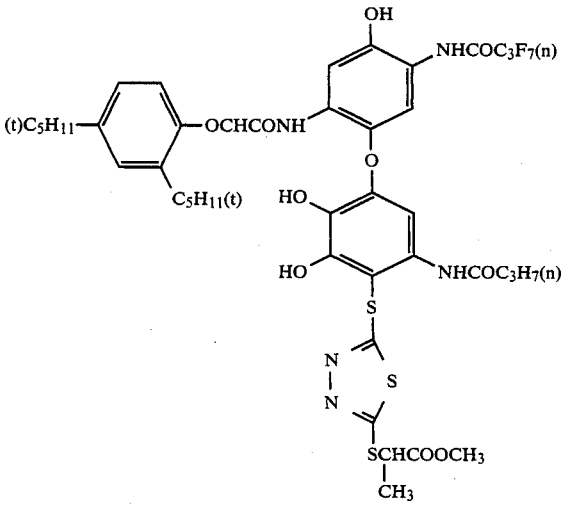
EX-11
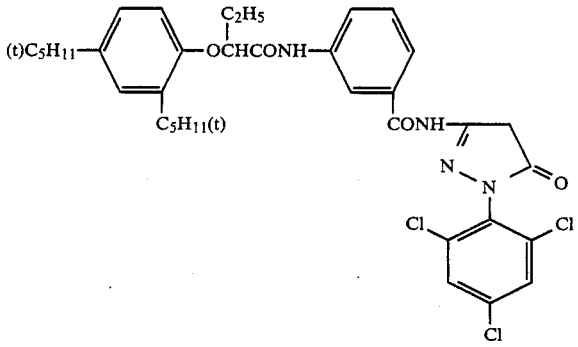
EX-12
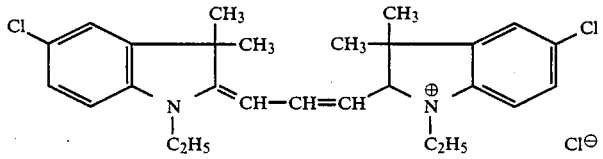
S-1
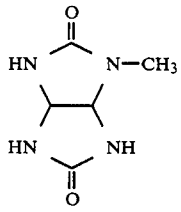
S-2
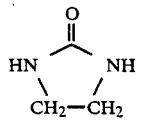
Tricresyl phosphate HBS-1
Dibutyl phthalate HBS-2
Bis(2-ethylhexyl)phthalate HBS-3
HBS-4
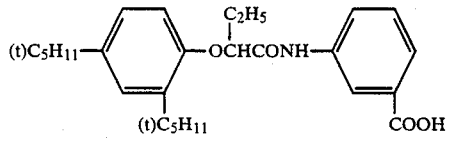

-continued
$CH_2{=}CH{-}SO_2{-}CH_2CONH{-}CH_2$
$CH_2{=}CH{-}SO_2{-}CH_2{-}CONH{-}CH_2$ H-1
Sensitizing dye
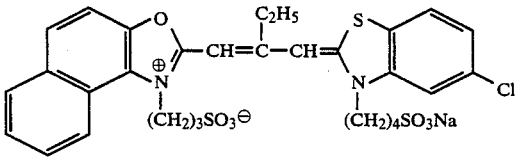
I
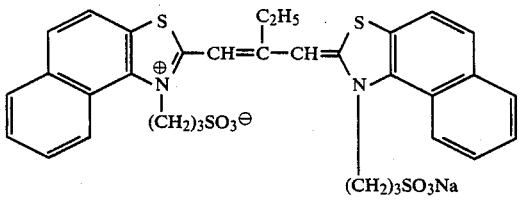
II
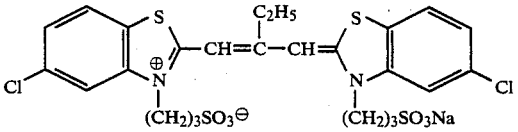
III
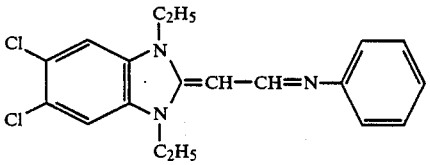
IV
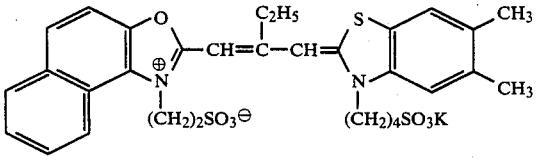
V
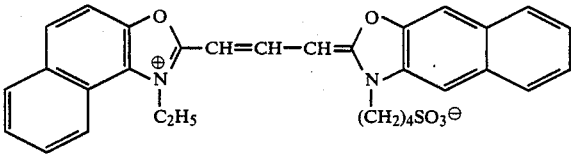
VI
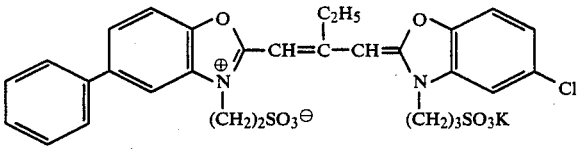
VII
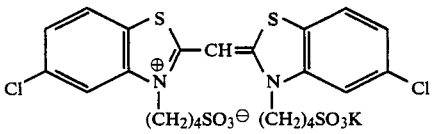
VIII -continued

IX

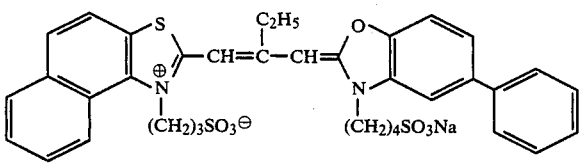

Specimen 102 was prepared in the same manner as Specimen 101 except that the coated amount of EX-2 incorporated in the 3rd layer was 0.38 g/m$^2$, the silver bromoiodide emulsion (silver halide content: 16 mol %; average grain diameter: 1.1 μm) incorporated in the 5th layer was replaced by a silver bromochloroiodide emulsion (silver iodide content: 16 mol %; silver chloride content: 5 mol %; average grain diameter: 1.15 μm) in a coated amount of 1.45 g/m$^2$ (calculated as the amount of silver), the coated amount of EX-6 incorporated in the 7th layer was 0.28 g/m$^2$, the silver bromoiodide emulsion incorporated in the 9th layer (silver iodide content: 12 mol %; average grain diameter: 1.0 μm) was replaced by a silver bromoiodide emulsion (silver iodide content: 10 mol %; average grain diameter: 1.05 μm) in a coated amount of 1.1 g/m$^2$ (calculated as the amount of silver), the coated amount of EX-9 incorporated in the 11th layer was 0.95 g/m$^2$, and the silver bromoiodide emulsion incorporated in the 13th layer (silver iodide content: 14 mol %; average grain diameter: 1.3 μm) was replaced by a silver bromoiodide emulsion (silver iodide content: 16 mol %; average grain diameter 1.35 μm) in a coated amount of 0.65 g/m$^2$ (calculated in terms of the amount of silver).

Specimen 103 was prepared in the same manner as Specimen 101 except that the coated amount of EX-2 incorporated in the 3rd layer was 0.40 g/m$^2$, the silver bromoiodide emulsion incorporated in the 5th layer (silver iodide content: 16 mol%; average grain diameter: 1.1 μm) was replaced by a silver bromochloroiodide emulsion (silver iodide content: 16 mol %; silver chloride content: 5 mol %; average grain diameter: 1.15 μm) in a coated amount of 1.30 g/m$^2$ (calculated as silver), the coated amount of EX-6 incorporated in the 7th layer was 0.30 g/m$^2$, the silver bromoiodide emulsion incorporated in the 9th layer (silver iodide content: 12 mol %; average grain diameter: 1.0 μm) was replaced by a silver bromoiodide emulsion (silver iodide content: 10 mol %; average grain diameter: 1.05 μm) in a coated amount of 1.0 g/m$^2$ (calculated as silver), the coated amount of EX-9 incorporated in the 11th layer was 1.05 g/m$^2$, and the silver bromoiodide emulsion incorporated in the 13th layer (silver iodide content: 14 mol %; average grain diameter 1.3 μm) was replaced by a silver bromoiodide emulsion (silver iodide content: 16 mol %; average grain diameter: 1.4 μm) in a coated amount of 0.6 g/m$^2$ (calculated in terms of silver).

Specimen 104 was prepared in the same manner as Specimen 103 except that the coated amount of EX-2 incorporated in the 4th layer was 0.60 g/m$^2$, the silver bromoiodide emulsion incorporated in the 5th layer (silver iodide content: 16 mol %; average grain diameter 1.1 μm) was replaced by a silver bromochloroiodide emulsion (silver iodide content: 16 mol %; silver chloride content: 5 mol %; average grain diameter: 1.4 μm) in a coated amount of 0.80 g/m$^2$ (calculated in terms of silver), the coated amount of EX-6 incorporated in the 8th layer was 0.20 g/m$^2$, the silver bromoiodide emulsion incorporated in the 9th layer (silver iodide content: 12 mol %; average grain diameter: 1.0 μm) was. replaced by a silver bromoiodide emulsion (silver iodide content 10 mol %; average grain diameter: 1.3 μm) in a coated amount of 0.8 g/m$^2$ (calculated in terms of silver), the coated amount of EX-9 incorporated in the 12th layer was 0.40 g/m$^2$, and the silver bromoiodide emulsion to be incorporated in the 13th layer (silver iodide content: 14 mol %; average grain diameter: 1.3 μm) was replaced by a silver bromoiodide emulsion (silver iodide content 16 mol %; average grain diameter 1.5 μm) in a coated amount of 0.5 g/m$^2$ (calculated in terms of silver).

A multilayer color light-sensitive material specimen 105 was prepared by coating various layers having the undermentioned compositions on an following cellulose triacetate film support.

Composition of light-sensitive layer

The value of the coated amount of each component is represented in g/m$^2$, and the coated amount of silver halide is represented in terms of amount of silver. The coated amount of sensitizing dye is represented in terms of mol per 1 mol of silver halide incorporated in the same layer. The compounds used were the same as those above, except for the additional compounds identified below.

| Specimen 105 | |
|---|---|
| 1st layer: antihalation layer | |
| Black colloidal silver (diameter: 0.1 μm) | 0.2 |
| Gelatin | 1.4 |
| U-1 | 0.02 |
| U-2 | 0.04 |
| U-3 | 0.04 |
| HBS-2 as described above | 0.05 |
| 2nd layer: intermediate layer | |
| Fine silver bromide grain (average grain diameter: 0.07 μm) | 0.08 |
| Gelatin | 1.1 |
| EX-3 | 0.02 |
| EX-1 | 0.06 |
| U-1 | 0.03 |
| U-2 | 0.06 |
| U-3 | 0.07 |
| Cpd-1 | 0.1 |
| EX-12 | 0.004 |
| HBS-2 | 0.1 |
| HBS-1 | 0.09 |
| 3rd layer: low sensitive red-sensitive emulsion layer | |
| Silver bromoiodide emulsion (AgI content: 6.3 mol %; internal high AgI type; diameter in terms of sphere: 0.8 μm; coefficient of variation in diameter in terms of sphere: 25%; tabular grain; diameter/thickness ratio: 2) | 1.5 |
| Gelatin | 1.7 |
| EX-2 | 0.3 |
| EX-13 | 0.02 |
| Sensitizing dye IX | $7.1 \times 10^{-5}$ |
| Sensitizing dye II | $1.9 \times 10^{-5}$ |
| Sensitizing dye III | $2.4 \times 10^{-4}$ |
| Sensitizing dye IV | $4.2 \times 10^{-5}$ |
| HBS-1 | 0.03 |
| 4th layer: middle sensitive red-sensitive emulsion layer | |
| Silver bromoiodide emulsion (AgI content: 4.8 mol %; internal high AgI type: diameter in terms of sphere: 0.9 μm; coefficient of variation in diameter in terms of sphere: 50%; tabular garin; diameter/thickness | |

-continued

Specimen 105

| | |
|---|---|
| ratio: 1.5) | 1.4 |
| Gelatin | 2.1 |
| EX-3 | 0.4 |
| EX-13 | 0.002 |
| Sensitizing dye IX | $5.2 \times 10^{-5}$ |
| Sensitizing dye II | $1.4 \times 10^{-5}$ |
| Sensitizing dye III | $1.8 \times 10^{-4}$ |
| Sensitizing dye IV | $3.1 \times 10^{-5}$ |
| HBS-1 | 0.5 |

5th layer: high sensitive red-sensitive emulsion layer
Silver bromoiodide emulsion (AgI content: 10.2 mol %; internal high AgI type; diameter in terms of sphere: 1.2 μm; coefficient of variation in diameter in terms of sphere: 35%; tabular grain; diameter/thickness:

| | |
|---|---|
| 3.5) | 2.1 |
| Gelatin | 2.0 |
| EX-3 | 0.06 |
| EX-14 | 0.04 |
| EX-15 | 0.2 |
| Sensitizing dye IX | $6.5 \times 10^{-5}$ |
| Sensitizing dye II | $1.7 \times 10^{-5}$ |
| Sensitizing dye III | $2.2 \times 10^{-4}$ |
| Sensitizing dye IV | $3.8 \times 10^{-5}$ |
| HBS-2 | 0.1 |
| HBS-1 | 0.3 |

6th layer: intermediate layer

| | |
|---|---|
| Gelatin | 1.1 |

7th layer: low sensitive green-sensitive emulsion layer
Silver bromoiodide emulsion (AgI content: 6.3 mol %; internal high AgI type; diameter in terms of sphere: 0.8 μm; coefficient of variation in diameter of sphere: 25%; tabular grain; diameter/thickness: 2)

| | |
|---|---|
| | 0.6 |
| Gelatin | 0.8 |
| EX-16 | 0.3 |
| EX-1 | 0.03 |
| EX-7 | 0.05 |
| EX-8 | 0.04 |
| Sensitizing dye V | $3.1 \times 10^{-5}$ |
| Sensitizing dye X | $1.0 \times 10^{-4}$ |
| Sensitizing dye VII | $3.8 \times 10^{-4}$ |
| H-1 | 0.04 |
| H-2 | 0.01 |
| HBS-1 | 0.2 |

8th layer: middle sensitive green-sensitive emulsion layer
Silver bromoiodide emulsion (AgI content: 4.8 mol %; internal high AgI type; diameter in terms of sphere: 0.9 μm; coefficient of variation in terms of sphere 50%; tabular grain; diameter/thickness ratio: 1.5)

| | |
|---|---|
| | 1.1 |
| Gelatin | 1.4 |
| EX-17 | 0.2 |
| EX-11 | 0.05 |
| EX-1 | 0.01 |
| EX-7 | 0.01 |
| EX-8 | 0.02 |
| Sensitizing dye V | $2.0 \times 10^{-5}$ |
| Sensitizing dye X | $7.0 \times 10^{-5}$ |
| Sensitizing dye VII | $2.6 \times 10^{-4}$ |
| H-1 | 0.07 |
| H-2 | 0.02 |
| HBS-2 | 0.06 |
| HBS-1 | 0.4 |

9th layer: high sensitive green-sensitive emulsion layer
Silver bromoiodide emulsion (AgI content: 10.2 mol %; internal high AgI type; diameter in terms of sphere: 1.2 μm; coefficient of variation in diameter in terms of sphere: 38%; tabular grain; diameter/thickness

| | |
|---|---|
| ratio: 4) | 2.1 |
| Gelatin | 2.2 |
| EX-3 | 0.02 |
| EX-11 | 0.1 |
| EX-1 | 0.05 |
| Sensitizing dye V | $3.5 \times 10^{-5}$ |
| Sensitizing dye X | $8.0 \times 10^{-5}$ |
| Sensitizing dye VII | $3.0 \times 10^{-4}$ |
| HBS-2 | 0.08 |
| HBS-1 | 0.7 |

10th layer: yellow filter layer

| | |
|---|---|
| Yellow colloidal silver (diameter: 0.1 μm) | 0.05 |
| Gelatin | 0.1 |
| Cpd-1 | 0.1 |

11th layer: low sensitive blue-sensitive emulsion layer
Silver bromoiodide emulsion (AgI content: 9.0 mol %; internal high AgI type; diameter in terms of sphere 0.75 μm; coefficient of variation in diameter in terms of sphere: 21%; octahedral grain; diameter/thickness

| | |
|---|---|
| ratio: 1) | 0.3 |
| Gelatin | 1.3 |
| EX-9 | 0.7 |
| EX-8 | 0.03 |
| H-1 | 0.03 |
| H-2 | 0.01 |
| HBS-1 | 0.3 |

12th layer: middle sensitive blue-sensitive emulsion layer
Silver bromoiodide emulsion (AgI content: 10.2 mol %; internal high AgI type; diameter in terms of sphere: 1.0 μm; coefficient of variation in diameter in terms of sphere: 30%; tabular grain; diameter/thickness

| | |
|---|---|
| ratio: 3.5) | 0.4 |
| Gelatin | 0.7 |
| EX-9 | 0.1 |
| Sensitizing dye VIII as described above | $2.2 \times 10^{-4}$ |
| H-1 | 0.01 |
| H-2 | 0.005 |
| HBS-1 | 0.05 |

13th layer: high sensitive blue-sensitive emulsion layer
Silver bromoiodide emulsion (AgI content: 9.8 mol %; internal high AgI type; diameter in terms of sphere: 1.8 μm; coefficient of variation in diameter in terms of sphere: 55%; tabular grain; diameter/thickness

| | |
|---|---|
| ratio: 4.5) | 0.8 |
| Gelatin | 0.7 |
| EX-9 | 0.2 |
| Sensitizing dye VIII as described above | $2.3 \times 10^{-4}$ |
| HBS-1 | 0.07 |

14th layer: 1st protective layer

| | |
|---|---|
| Gelatin | 0.9 |
| U-4 | 0.1 |
| U-5 | 0.2 |
| H-1 | 0.02 |
| H-2 | 0.005 |
| HBS-5 | 0.03 |
| S-1 | 0.7 |

15th layer: 2nd protective layer

| | |
|---|---|
| Fine silver bromide grains (average grain diameter: 0.07 μm) | 0.1 |
| Gelatin | 0.7 |
| H-1 | 0.2 |
| H-2 | 0.05 |

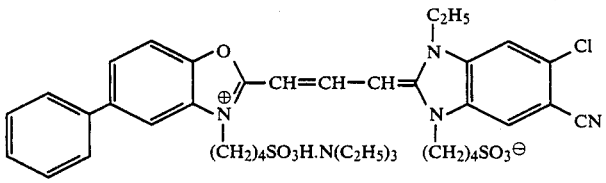

Sensitizing dye X

-continued
EX-13
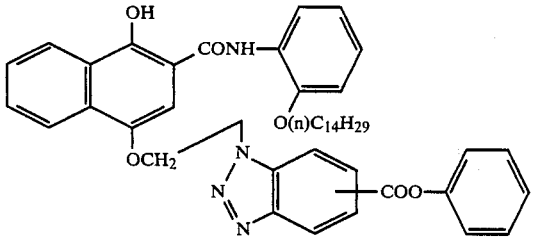
EX-14
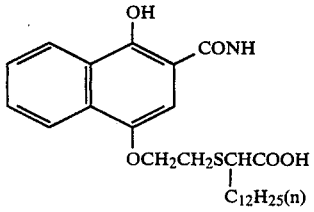
EX-15
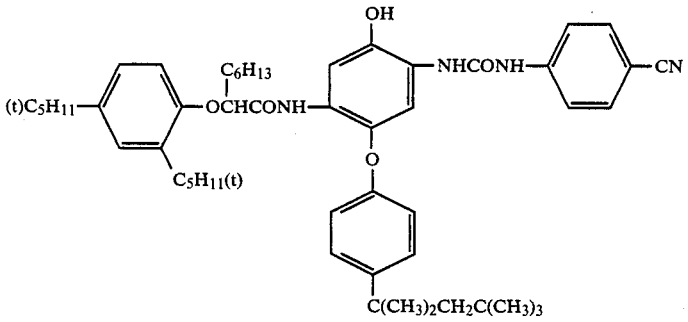
EX-16
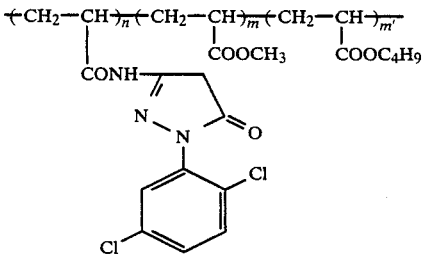
n/m + m' = 1
n/m' = 1
Molecular weight approx. 40,000
EX-17
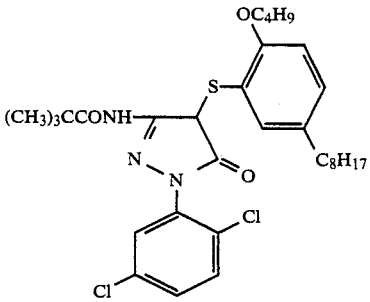
Cpd-1
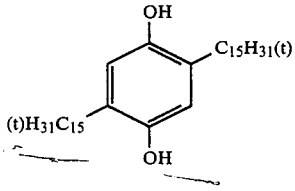

-continued

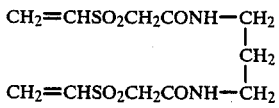

H-2

$(C_6H_{13}O)_3P{=}O$

HBS-5

A multilayer color light-sensitive material specimen 106 was prepared by coating various layers having the following compositions on an undercoated cellulose triacetate film support. The compounds used were the same as those used above, and additional compounds are described below.

Composition of light-sensitive layer

The the coated amount of each component is represented in g/m$^2$, and the coated amount of silver halide is represented in terms of the amount of silver. The coated amount of sensitizing dye is represented in terms of mol per 1 mol of silver halide incorporated in the same layer.

| Specimen 106 | |
|---|---|
| 1st layer: antihalation layer | |
| Black colloidal silver (diameter: 0.1 μm) | 0.13 |
| Gelatin | 1.0 |
| U-6 | 0.05 |
| U-2 | 0.1 |
| U-7 | 0.1 |
| HBS-2 | 0.02 |
| 2nd layer: intermediate layer | |
| Gelatin | 1.0 |
| 3rd layer: 1st red-sensitive emulsion layer | |
| Monodisperse silver bromoiodide emulsion (silver iodide.content: 7 mol %; average grain diameter: μm; coefficient of variation: 13%) | 0.7 |
| | 1.72 |
| Gelatin | 0.9 |
| Sensitizing dye XI | $2.0 \times 10^{-4}$ |
| Sensitizing dye III | $1.0 \times 10^{-4}$ |
| Sensitizing dye II | $0.3 \times 10^{-4}$ |
| EX-18 | 0.40 |
| EX-19 | 0.047 |
| EX 30 | 0.05 |
| HBS-1 | 0.10 |
| HBS-6 | 0.10 |
| 4th layer: intermediate layer | |
| Gelatin | 0.4 |
| EX-21 | 0.10 |
| HBS-6 | 0.05 |
| 5th layer: 2nd red-sensitive emulsion layer | |
| Monodisperse silver bromoiodide emulsion (silver iodide content: 5 mol %; average grain diameter: μm; coefficient of variation: 16%) | 1.3 |
| Gelatin | 1.0 |
| Sensitizing dye XI | $1.5 \times 10^{-4}$ |
| Sensitizing dye III | $2.0 \times 10^{-4}$ |
| Sensitizing dye II | $0.5 \times 10^{-4}$ |
| EX 20 | 0.150 |
| EX-18 | 0.027 |
| HBS-6 | 0.050 |
| HBS-2 | 0.060 |
| 6th layer: intermediate layer | |
| Gelatin | 1.0 |
| EX-26 | 0.05 |
| Cpd-2 | 0.05 |
| HBS-2 | 0.05 |
| 7th layer: 1st green-sensitive layer | |
| Monodisperse silver bromoiodide emulsion (silver iodide content: 7 mol %; average grain diameter: μm; coefficient of variation: 19%) | 0.4 |
| | 0.64 |
| Monodisperse silver bromoiodide emulsion (silver iodide content: 6 mol %; average grain diameter: μm; coefficient of variation: 18%) | 0.7 |
| | 0.40 |
| Gelatin | 1.0 |

-continued

| Specimen 106 | |
|---|---|
| Sensitizing dye XII | $1 \times 10^{-4}$ |
| Sensitizing dye XIII | $4 \times 10^{-4}$ |
| Sensitizing dye XIV | $1 \times 10^{-4}$ |
| EX-23 | 0.20 |
| EX-22 | 0.61 |
| EX-24 | 0.084 |
| HBS-6 | 0.25 |
| HBS-2 | 0.45 |
| 8th layer: intermediate layer | |
| Gelatin | 0.4 |
| EX-22 | 0.10 |
| HBS-6 | 0.05 |
| 9th layer: 2nd green-sensitive emulsion layer | |
| Monodisperse silver bromoiodide emulsion (silver iodide content: 6 mol %; average grain diameter μm; coefficient of variation: 18%) | 1.0 |
| | 2.23 |
| Gelatin | 1.5 |
| Sensitizing dye XII | $1.5 \times 10^{-4}$ |
| Sensitizing dye XIII | $2.3 \times 10^{-4}$ |
| Sensitizing dye XIV | $1.5 \times 10^{-4}$ |
| EX-22 | 0.020 |
| EX-25 | 0.009 |
| HBS-2 | 0.088 |
| 10th layer: intermediate layer | |
| Yellow colloidal silver (diameter: 0.1 μm) | 0.12 |
| Gelatin | 1.2 |
| EX-25 | 0.006 |
| EX-26 | 0.3 |
| HBS-6 | 0.3 |
| 11th layer: 1st blue-sensitive emulsion layer | |
| Monodisperse silver bromoiodide emulsion (silver iodide content: 6 mol %; average grain diameter: μm; coefficient of variation: 20%) | 0.4 |
| | 0.20 |
| Monodisperse silver bromoiodide emulsion (silver iodide content: 5 mol %; average grain diameter: μm ; coefficient of variation 17%) | 0.9 |
| | 0.20 |
| Gelatin | 2.0 |
| Sensitizing dye XV | $1 \times 10^{-4}$ |
| Snsitizing dye XVI | $1 \times 10^{-4}$ |
| EX-27 | 0.63 |
| EX-28 | 0.57 |
| EX-30 | 0.035 |
| HBS-6 | 0.05 |
| 12th layer: 2nd blue-sensitive emulsion layer | |
| Monodisperse silver bromoiodid emulsion (silver iodide content: 8 mol %; averae grain diameter: μm ; coefficient of variation: 18%) | 1.3 |
| | 1.11 |
| Gelatin | 0.5 |
| Sensitizing dye XV | $5 \times 10^{-5}$ |
| Sensitizing dye XVI | $5 \times 10^{-5}$ |
| EX-27 | 0.10 |
| EX-28 | 0.10 |
| EX-31 | 0.005 |
| HBS-2 | 0.10 |
| 13th layer: intermediate layer | |
| Gelatin | 0.5 |
| EX-29 | 0.1 |
| U-6 | 0.1 |
| U-2 | 0.1 |
| U-7 | 0.1 |
| HBS-6 | 0.05 |
| HBS-2 | 0.05 |
| 14th layer: protective layer | |
| Monodisperse silver bromoiodide emulsion (silver iodide content: 4 mol %; average grain. diameter: 0.05 μm; coefficient of variation: 10%) | 0.32 |
| Gelatin | 1.5 |

-continued
| Specimen 106 | |
|---|---|
| Polymethyl methacrylate grain (average grain diameter; 1.5 μm) | 0.1 |
| S-3 | 0.2 |
| S-4 | 0.2 |
Sensitizing dye XI
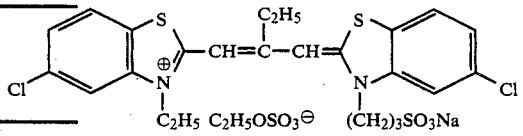
Sensitizing dye XII
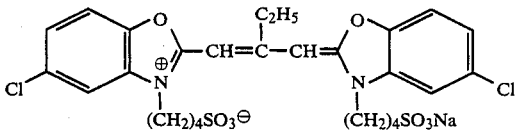
Sensitizing dye XIII
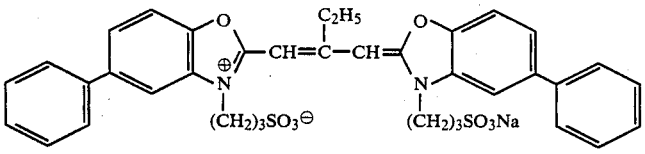
Sensitizing dye XIV
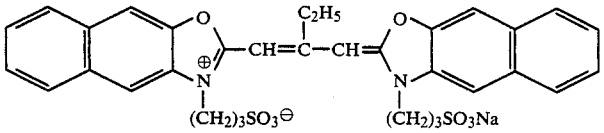
Sensitizing dye XV
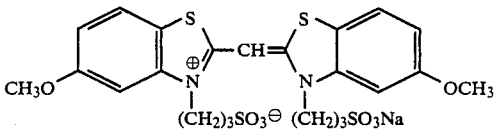
Sensitizing dye XVI
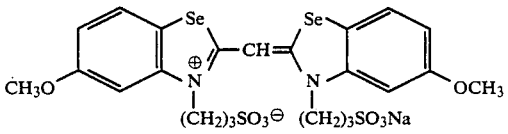
U-7
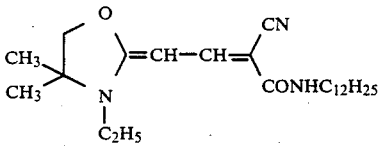
Compound Cpd-2
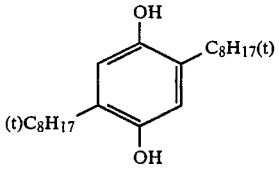
H-3

-continued
$CH_2{=}CH{-}SO_2{-}CH_2$
$CH_2{=}CH{-}SO_2{-}CH_2$
EX-18
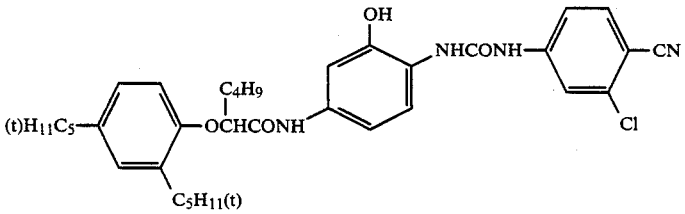
EX-19
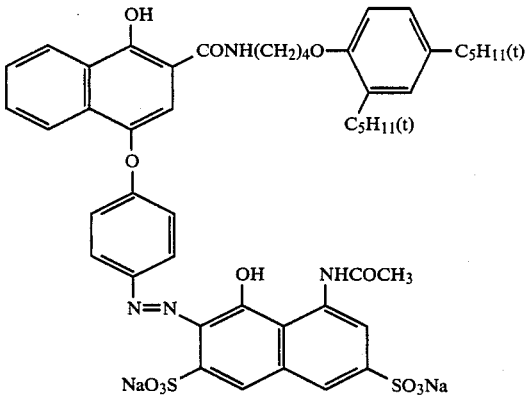
EX-20
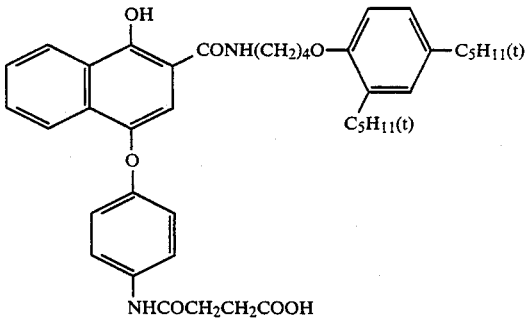
EX-21
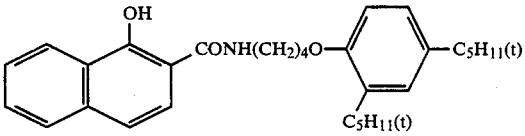
EX-22

-continued
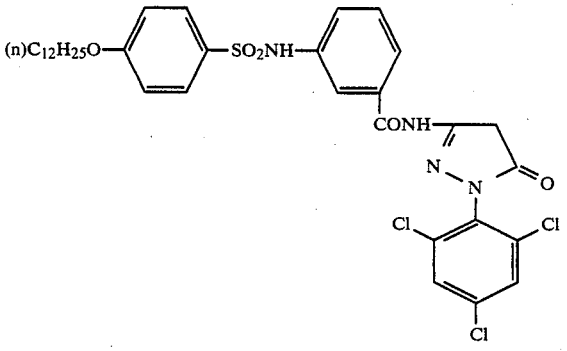
EX-23
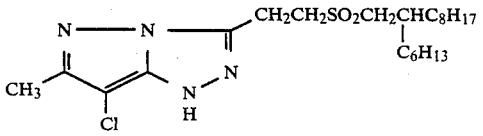
EX-24
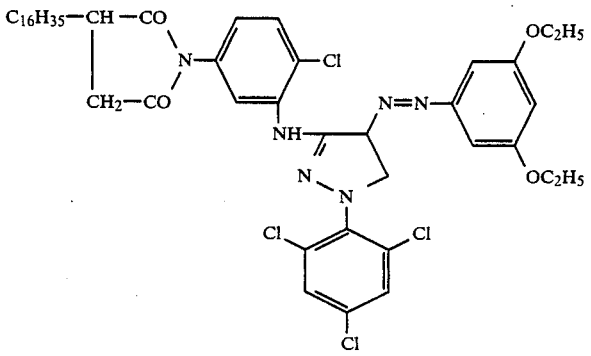
EX-25
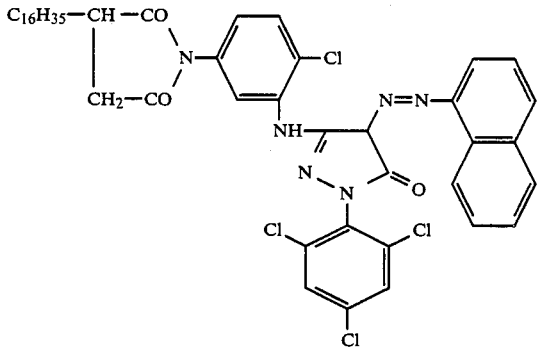
EX-26

-continued
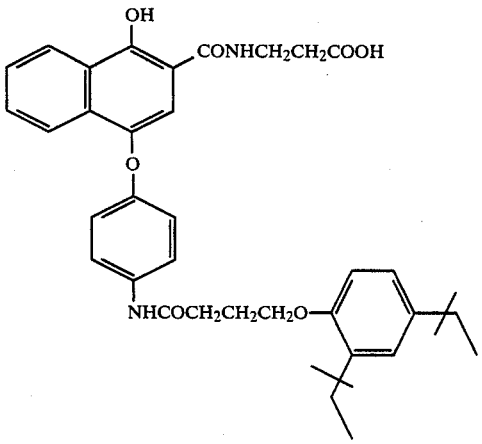
EX-27
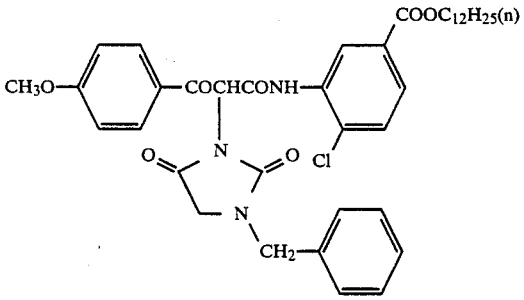
EX-28
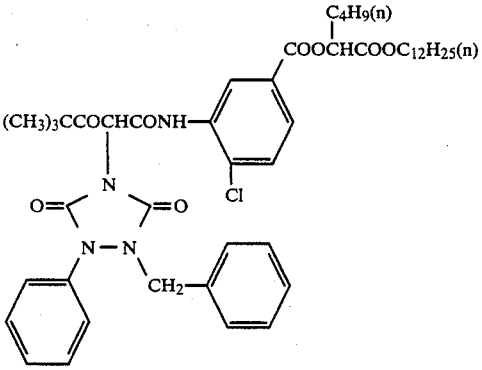
EX-29
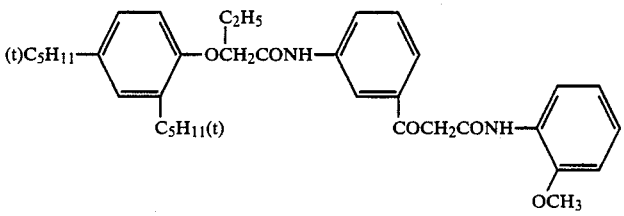
EX-30

-continued
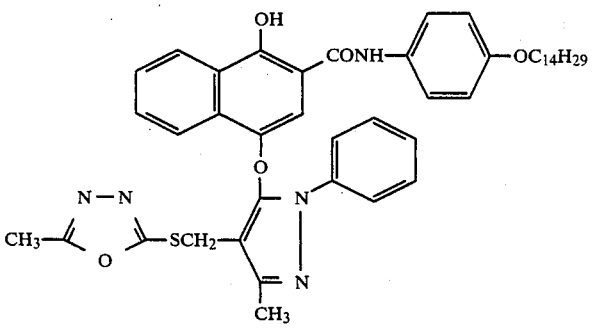
EX-31
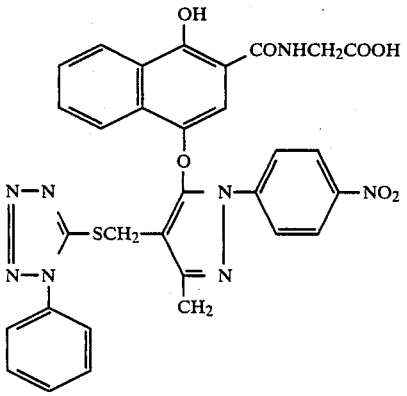
HBS-6
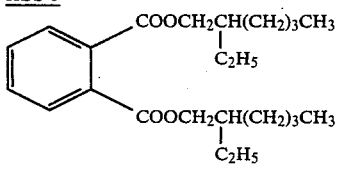
K-1
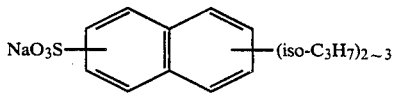
S-3
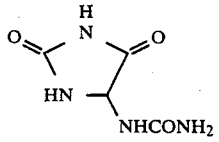
S-4
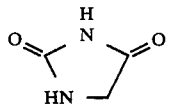
U-6
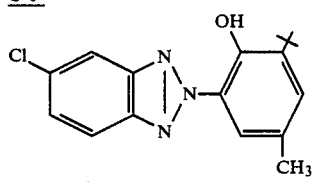
Specimen 107 was prepared in the same manner as Specimen 106 except that the coated amount of EX-18

A multilayer color light-sensitive material specimen 108 was prepared by coating various layers having the following compositions on an undercoated cellulose triacetate film support. The compounds used were the same as used above, with additional compounds identified below.

Composition of light-sensitive layer

The coated amount of silver halide and colloidal silver is represented by $g/m^2$ calculated in terms of the amount of silver. The amounts of coupler, additive and gelatin are represented in $g/m^2$. The coated amount of sensitizing dye is represented in terms of mol per 1 mol of silver halide incorporated in the same layer.

| Specimen 108 | |
|---|---|
| 1st layer: antihalation layer | |
| Black colloidal silver (diameter: 0.1 μm) | 0.2 |
| Gelatin | 1.3 |
| EX-1 | 0.06 |
| U-1 | 0.03 |
| U-2 | 0.06 |
| U-3 | 0.06 |
| HBS-1 | 0.1 |
| HBS-2 | 0.15 |
| HBS-7 | 0.05 |
| 2nd layer; intermediate layer | |
| Gelatin | 1.0 |
| U-1 | 0.03 |
| EX-3 | 0.02 |
| EX-12 | 0.004 |
| HBS-1 | 0.1 |
| HBS-2 | 0.1 |
| 3rd layer: low sensitive red-sensitive emulsion layer | |
| Silver bromoiodide emulsion (AgI content: 4 mol %; uniform AgI type; diameter in terms of sphere 0.5 μm; coefficient of variation in diameter in terms of sphere: 20%; tabular grain; diameter/thickness: 3.0) | 1.2 |
| Silver bromoiodide emulsion (AgI content: 3 mol %; uniform AgI type; diameter in terms of sphere: 0.3 μm; coefficient of variation in diameter in terms of sphere: 15%; spherical grain; diameter/thickness ratio: 1.0) | 0.6 |
| Gelatin | 1.0 |
| Sensitizing dye I | $4 \times 10^{-4}$ |
| Sensitizing dye II | $1 \times 10^{-5}$ |
| Sensitizing dye III | $5 \times 10^{-5}$ |
| Sensitizing dye IV | $4 \times 10^{-5}$ |
| EX-32 | 0.05 |
| EX-2 | 0.50 |
| EX-10 | 0.03 |
| EX-3 | 0.12 |
| EX-13 | 0 01 |
| 4th layer: high sensitive red-sensitive emulsion layer | |
| Silver bromoiodide emulsion (AgI content: 6 mol %; internal high AgI type with core/shell ratio of 1 1; diameter in terms of sphere: 0.7 μm; coefficient of variation in diameter in terms of sphere: 15%; tabular grain; diameter/thickness ratio: 5.0) | 0.7 |
| Gelatin | 1.0 |
| Sensitizing dye I | $3 \times 10^{-4}$ |
| Sensitizing dye III | $2.3 \times 10^{-5}$ |
| EX 15 | 0.11 |
| EX-4 | 0.05 |
| EX-3 | 0.05 |
| HBS-1 | 0.05 |
| HBS-7 | 0.05 |
| 5th layer: intermediate layer | |
| Gelatin | 0.5 |
| EX-5 | 0.1 |
| HBS-1 | 0.05 |
| 6th layer: low sensitive green-sensitive emulsion layer | |
| Silver bromoiodide emulsion (AgI content: 4 mol %; surface high AgI type with core/sell ratio: 1:1; diameter in terms of sphere: 0.5 μm; coefficient of variation in diameter in terms of sphere: 15%; tabular grain; diameter/thickness ratio: 4.0) | 0.35 |
| Silver bromoiodide emulsion (AgI content: 3 mol %; uniform AgI type; diameter in terms of sphere: 0.3 μm; coefficient of variation in diameter in terms of sphere: 25%; spherical grain; diameter/thickness: 1.0) | 0.20 |
| Gelatin | 1.0 |
| Sensitizing dye XVII | $5 \times 10^{-4}$ |
| Sensitizing dye VII | $3 \times 10^{-4}$ |
| Sensitizing dye V | $5 \times 10^{-5}$ |
| Sensitizing dye VI | $3 \times 10^{-5}$ |
| EX-6 | 0.4 |
| EX-1 | 0.07 |
| EX-33 | 0.02 |
| EX-34 | 0.03 |
| HBS-1 | 0.3 |
| HBS-4 | 0.05 |
| 7th layer: high sensitive green-sensitive emulsion layer | |
| Silver bromoiodide emulsion (AgI content: 4 mol %; internal high AgI type with core/shell ratio: 1:3; diameter in terms of sphere: 0.7 μm; coefficient of variation in diameter in terms of sphere: 20%; tabular grain; diameter/thickness: 5.0) | 0.8 |
| Gelatin | 0.5 |
| Sensitizing dye XVII | $5 \times 10^{-4}$ |
| Sensitizing dye VII | $3 \times 10^{-4}$ |
| Sensitizing dye V | $1 \times 10^{-5}$ |
| EX-6 | 0.1 |
| EX-1 | 0.02 |
| EX-34 | 0.03 |
| EX-2 | 0.03 |
| EX-35 | 0.01 |
| HBS-1 | 0.2 |
| HBS-4 | 0.01 |
| 8th layer: intermediate layer | |
| Gelatin | 0.5 |
| EX-5 | 0.05 |
| HBS-1 | 0.02 |
| 9th layer: donor layer having an interlayer effect with respect to red-sensitive layer | |
| Silver bromoiodide emulsion (AgI content: 2 mol %; internal high AgI type with core/shell ratio of 2:1; diameter in terms of sphere: 1.0 μm; coefficient of variation in diameter in terms of sphere: 15%; tabular grain; diameter/thickness ratio: 6.0) | 0.35 |
| Silver bromoiodide emulsion (AgI content: 2 mol %; internal high AgI type with core/shell ratio of 1 1; diameter in terms of sphere: 0.4 μm; coefficient of variation in diameter in terms of sphere: 20%; tabular grain; diameter/thickness ratio: 6.0) | 0.20 |
| Gelatin | 0.5 |
| Sensitizing dye XVII | $8 \times 10^{-4}$ |
| EX-8 | 0.11 |
| EX-7 | 0.03 |
| EX-35 | 0.10 |
| HBS-1 | 0.20 |
| 10th layer: yellow filter layer | |
| Yellow colloidal silver (diameter: 0.1 μm) | 0.05 |
| Gelatin | 0.5 |
| Cpd-3 | 0.13 |
| HBS-1 | 0.13 |
| EX-5 | 0.10 |
| 11th layer: low sensitive blue-sensitive emulsion layer | |
| Silver bromoiodide emulsion (AgI content: 4.5 mol %; uniform AgI type; diameter in terms of sphere: 0.7 μm; coefficient of variation in diameter in terms of sphere: 15%; tabular grain; diameter/thickness ratio: 7.0) | 0.3 |
| Silver bromoiodide emulsion (AgI content: 3 mol %; uniform AgI type; diameter in terms of sphere: 0.3 μm; coefficient of variation in diameter in terms of sphere: 25%; tabular grain; djameter/thickness ratio: 7.0) | 0.15 |
| Gelatin | 1.6 |

-continued

| Specimen 108 | |
|---|---|
| Sensitizing dye VIII | $2 \times 10^{-4}$ |
| EX-10 | 0.05 |
| EX-2 | 0.10 |
| EX-42 | 0.02 |
| EX-8 | 0.07 |
| EX-9 | 1.0 |
| HBS-1 | 0.20 |
| 12th layer: high sensitive blue-sensitive emulsion layer | |
| Silver bromoiodide emulsion (AgI content: 10 mol %; internal high AgI type; diameter in terms of sphere 1.0 μm; coefficient of variation in terms of diameter of | sphere: 25%; multiple twin tabular grain; |
| diameter/thickness ratio: 2.0) | 0.5 |
| Gelatin | 0.5 |
| Sensitizing dye VIII | $1 \times 10^{-4}$ |
| EX-9 | 0.20 |

-continued

| Specimen 108 | |
|---|---|
| EX-8 | 0.01 |
| HBS-1 | 0.10 |
| 13th layer: 1st protective layer | |
| Gelatin | 0.8 |
| U-4 | 0.1 |
| U-5 | 0.15 |
| HBS-1 | 0.01 |
| HBS-2 | 0.01 |
| 14th layer: 2nd protective layer | |
| Fine silver bromoiodide grain (AgI content: 2 mol %; uniform AgI type; diameter in terms of sphere: 0.07 μm) | 0.5 |
| Gelatin | 0.45 |
| Polymethyl methacrylate grain (diameter: 1.5 μm) | 0.2 |
| H-1 | 0.4 |
| S-1 | 0.5 |
| S-2 as described above | 0.5 |

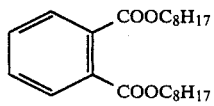

HE

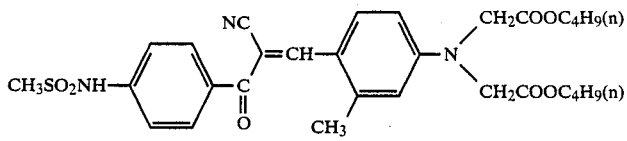

Cr

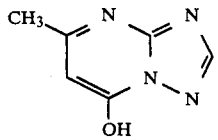

Cr

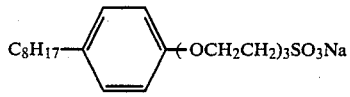

Cr

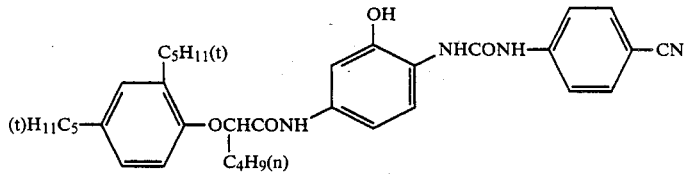

EX

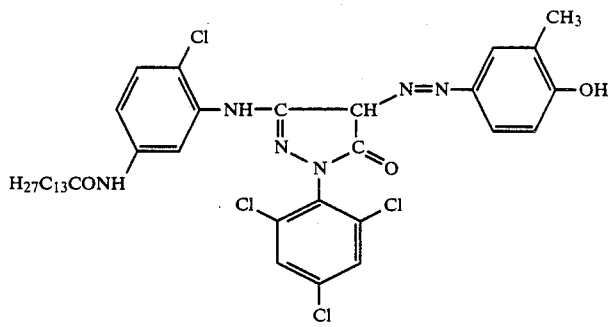

EX

-continued

EX-34

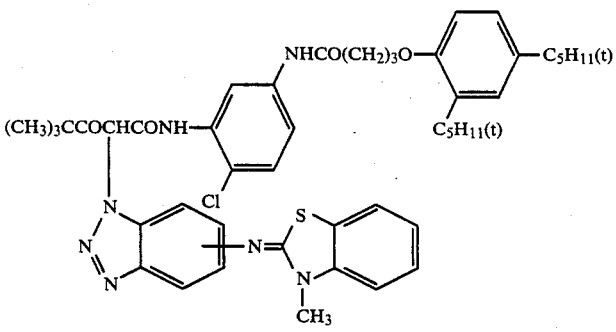

EX-35

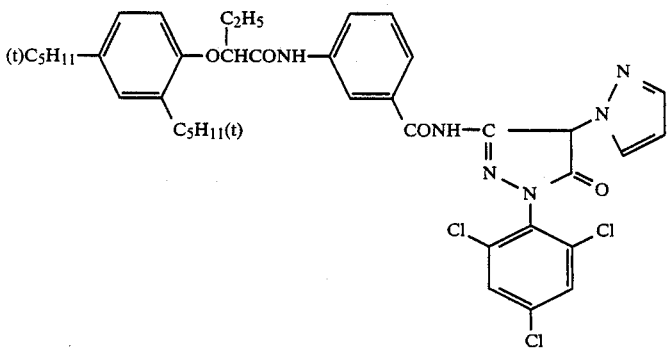

EX-42

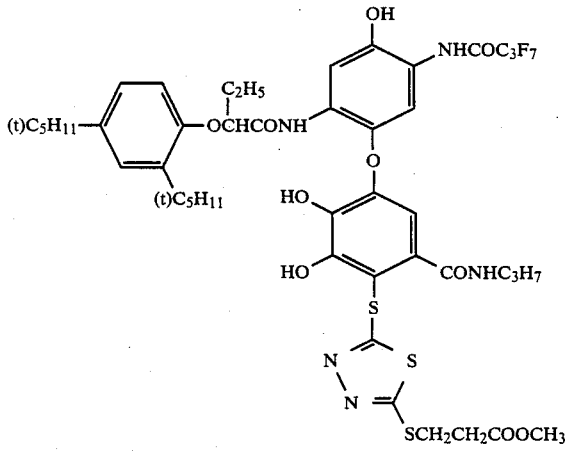

Sensitizing dye XVII

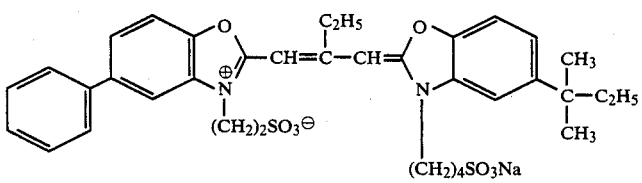

A multilayer color light-sensitive material specimen 109 was prepared by coating various layers having the following compositions on an undercoated cellulose triacetate film support. The compounds used were the same as above, with the following additional compounds.

Compositions of light-sensitive layer

The coated amount of silver halide and colloidal silver is represented by g/m$^2$, calculated in terms of the amount of silver. The coated amounts of coupler, additive and gelatin are represented in g/m$^2$. The coated amount of sensitizing dye is represented in terms of mol per 1 mol of silver halide incorporated in the same layer.

| Specimen 109 | |
|---|---|
| 1st layer: antihalation layer | |
| Black colloidal silver (diameter: 0.1 μm) | 0.2 |
| Gelatin | 1.3 |
| EX-1 | 0.06 |
| U-4 | 0.1 |
| U-5 | 0.2 |
| HBS-1 | 0.01 |
| HBS-2 | 0.01 |
| 2nd layer: intermediate layer | |

-continued

Specimen 109

| | |
|---|---|
| Fine silver bromide grain (average grain diameter: 0.07 μm) | 0.10 |
| Gelatin | 1.5 |
| U-1 | 0.06 |
| U-2 | 0.03 |
| EX-36 | 0.02 |
| EX-12 | 0.004 |
| HBS-1 | 0.1 |
| HBS-2 | 0.09 |
| 3rd layer: 1st red-sensitive emulsion layer | |
| Silver bromoiodide emulsion (AgI; content: 2 mol %; internal high AgI type; diamet in terms of sphere; 0.3 μm; coefficient of variation in diameter in terms of sphere: 29%; irregular grain; diameter/thickness ratio; 2.5) | 0.4 |
| Gelatin | 0.6 |
| Sensitizing dye I | $1.0 \times 10^{-4}$ |
| Sensitizing dye II | $3.0 \times 10^{-4}$ |
| Sensitizing dye III | $1 \times 10^{-5}$ |
| EX-32 | 0.06 |
| EX-37 | 0.06 |
| EX-13 | 0.04 |
| EX-36 | 0.03 |
| HBS-1 | 0.03 |
| HBS-3 | 0.012 |
| 4th layer: 2nd red-sensitive emulsion layer | |
| Silver bromoiodide emulsion (AgI content: 5 mol %; internal high AgI type; diameter in terms of sphere; 0.7 μm; coefficient of variation in diameter in terms of sphere: 25%; irregular grain; diameter/thickness ratio: 4) | 0.7 |
| Sensitizing dye I | $1 \times 10^{-4}$ |
| Sensitizing dye III | $3 \times 10^{-4}$ |
| Sensitizing dye II | $1 \times 10^{-5}$ |
| EX-32 | 0.24 |
| EX-37 | 0.24 |
| EX-13 | 0.04 |
| EX-36 | 0.04 |
| HBS-1 | 0.15 |
| HBS-3 | 0.02 |
| 5th layer: 3rd red-sensitive emulsion layer | |
| Silver bromoiodide emulsion (AgI content: 10 mol %; internal high AgI type; diameter in terms of sphere; 0.8 μm; coefficient of variation in diameter in terms of sphere: 16%; irregular grain; diameter/thickness ratio: 1.3) | 1.0 |
| Gelatin | 1.0 |
| Sensitizing dye I | $1 \times 10^{-4}$ |
| Sensitizing dye III | $3 \times 10^{-4}$ |
| Sensitizing dye II | $1 \times 10^{-5}$ |
| EX-15 | 0.5 |
| EX-38 | 0.1 |
| HBS-1 | 0.01 |
| HBS-2 | 0.05 |
| 6th layer: intermediate layer | |
| Gelatin | 1.0 |
| Cpd-6 | 0.03 |
| HBS-1 | 0.05 |
| 7th layer: 1st green-sensitive emulsion layer | |
| Silver bromoiodide emulsion (AgI content: 2 mol %; internal high AgI type; diameter in terms of sphere; 0.3 μm; coefficient of variatin in diameter in terms of sphere: 28%; irregular grain; diameter/thickness ratio: 2.5) | 0.30 |
| Gelatin | 1.0 |
| Sensitizing dye VII | $5 \times 10^{-4}$ |
| Sensitizing dye V | $0.3 \times 10^{-4}$ |
| Sensitizing dye X | $2 \times 10^{-4}$ |
| Gelatin | 1.0 |
| EX-6 | 0.2 |
| EX-8 | 0.03 |
| EX-1 | 0.03 |
| HBS-1 | 0.5 |
| 8th layer: 2nd green-sensitive emulsion layer | |

-continued

Specimen 109

| | |
|---|---|
| Silver bromoiodide emulsion (AgI content: 4 mol %; internal high AgI type; diameter in terms of sphere; 0.6 μm; coefficient of variation in diameter in terms of sphere: 38%; irregular grain: diameter/thickness ratio: 4) | 0.4 |
| Sensitizing dye VII | $5 \times 10^{-4}$ |
| Sensitizing dye X | $2 \times 10^{-4}$ |
| Sensitizing dye V | $0.3 \times 10^{-4}$ |
| EX-6 | 0.25 |
| EX-1 | 0.03 |
| EX-33 | 0.015 |
| EX-8 | 0.01 |
| HBS-1 | 0.2 |
| 9th layer: 3rd green-sensitive emulsion layer | |
| Silver bromoiodide emulsion (AgI content: 6 mol %; internal high AgI type; diameter in terms of sphere; 1.0 μm; coefficient of variation in diameter in terms of sphere: 80%; irregular grain: diameter/thickness ratio: 1.2) | 0.85 |
| Gelatin | 1.0 |
| Sensitizing dye XVIII | $3.5 \times 10^{-4}$ |
| Sensitizing dye XIX | $1.4 \times 10^{-4}$ |
| EX-39 | 0.01 |
| EX-11 | 0.03 |
| EX-35 | 0.20 |
| EX-1 | 0.02 |
| EX-34 | 0.02 |
| HBS-1 | 0.20 |
| HBS-2 | 0.05 |
| 10th layer: yellow filter layer | |
| Gelatin | 1.2 |
| Yellow colloidal silver (diameter: 0.1 μm) | 0.08 |
| Cpd-7 | 0.1 |
| HBS-1 | 0.3 |
| 11th layer: 1st blue-sensitive emulsion layer | |
| Silver bromoiodide emulsion (AgI content: 4 mol %; internal high AgI type; diameter in terms of sphere; 0.5 μm; coefficient of variation in diameter in terms of sphere: 15%; ocatahedral grain) | 1.0 |
| Sensitizing dye VIII | $2 \times 10^{-4}$ |
| EX-9 | 0.9 |
| EX-8 | 0.07 |
| HBS-1 | 0.2 |
| 12th layer: 2nd blue-sensitive emulsion layer | |
| Silver bromoiodide emulsion (AgI content: 10 mol %; internal high AgI type; diameter in terms of sphere; 1.3 μm; coefficient of variation in diameter in terms of sphere: 25%; irregular grain; diameter/thickness ratio: 4.5) | 0.50 |
| Gelatin | 0.6 |
| Sensitizing dye VIII | $1 \times 10^{-4}$ |
| EX-9 | 0.25 |
| HBS-1 | 0.07 |
| 13th layer: 1st protective layer | |
| Gelatin | 0.8 |
| U-4 | 0.1 |
| U-5 | 0.2 |
| HBS-1 | 0.01 |
| HBS-2 | 0.01 |
| 14th layer: 2nd protective layer | |
| Fine silver bromide grain (average grain diameter: 0.07 μm) | 0.5 |
| Gelatin | 0.45 |
| polymethyl methacrylate grain (diameter: 1.5 μm) | 0.2 |
| H-1 | 0.2 |
| S-1 | 0.5 |
| S-2 | 0.5 |

Besides the above described components, 0.01 to 0.03 g/m$^2$ of a surface active agent was added to each layer as a coating aid. Thus, Specimen 107 was prepared.

EX-36
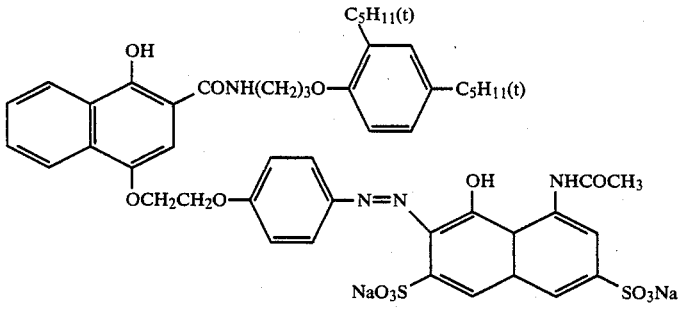
EX-37
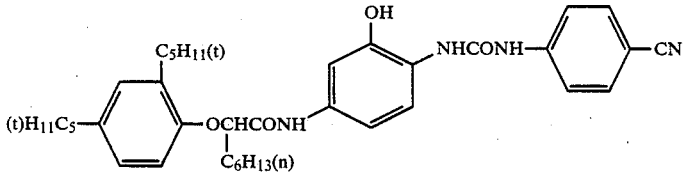
EX-38
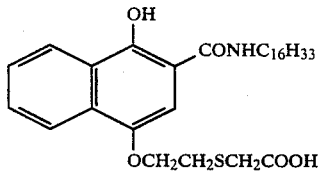
EX-39
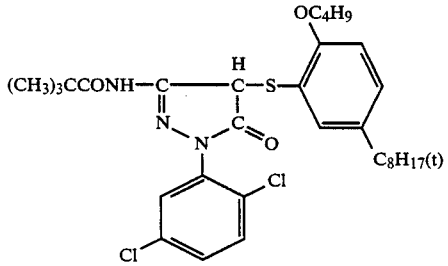
Cpd-6
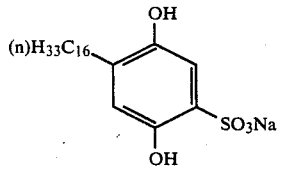
Cpd-7
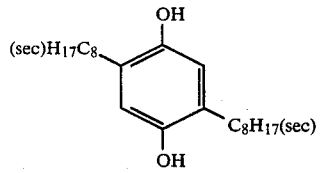
Sensitizing dye XVIII
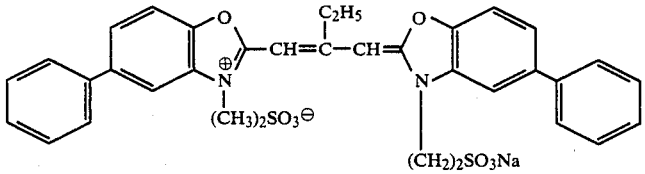

-continued

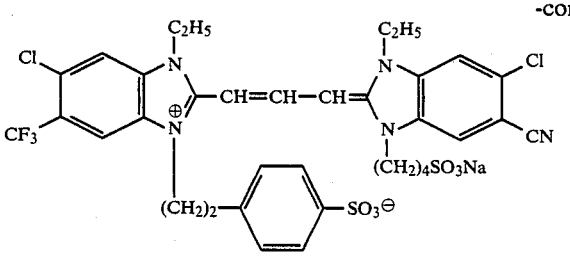

Sensitizing dye XIX

Specimen 110 was prepared in the same manner as Specimen 101 except that the emulsion of tabular silver bromoiodide grain incorporated in the 4th layer was replaced by an emulsion of twin silver bromoiodide grain (silver iodide content: 10 mol %; average grain diameter: 0.8 μm), the silver bromoiodide emulsion incorporated in the 5th layer was replaced by a silver bromochloroiodide eulsion (silver chloride content: 3 mol %; silver iodide content: 16 mol %; average grain diameter: 1.4 μm) in a coated amount of 2.5 g/m$^2$ (calculated in terms of silver), EX-40 and EX 41 were incorporated in the 6th layer in amounts of 0.06 g/m$^2$ and 0.03 g/m$^2$, respectively, the monodisperse silver bromoiodide emulsion incorporated in the 8th layer was replaced by an emulsion of twin silver bromoiodide grain (silver iodide content; 10 mol %; average grain diameter: 0.8 μm), and the average grain diameter of the silver bromoiodide emulsion grains incorporated in the 9th layer was 1.3 μm and the coated amount thereof was 1.8 g/m$^2$.

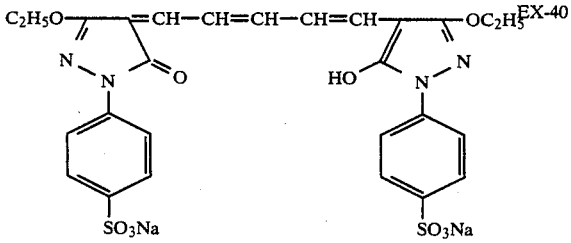

EX-40

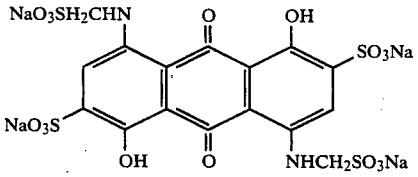

EX-41

The specific sensitivity of Specimens 101 to 110 were determined in accordance with the test method as set forth herein. The spectral reflectances of the film surfaces of Specimens 101 to 107 were measured by means of Hitachi, Ltd. spectrophotometer Type U-3200. An 18% gray card was photographed using Specimens 101 to 109 in an autostrobe mode with a strobe SB-12 and a 50-mm F 1.4 S lens mounted on Nippon Kogaku K.K. camera Type Nikon F3. The sensitivity of Specimens 101 to 107 were adjusted to ISO 400 while that of Specimens 108 and 109 were adjusted to ISO 160. The photographic distance was adjusted so that the luminance on the gray card corresponded to EV-11. The control of exposure by strobe was effected by an instant stop-down TTL direct exposure measurement process. In this exposure process, the strobe light reflected by the object passed through the lens with a F value previously set in the camera. The strobe light was then reflected by the emulsion surface of the film and then reached the light receiving element. The light measurement data were then transmitted to the strobe where it was operated for proper control of light emission. For comparison, the same gray card was photographed on the same specimens in a manual exposure mode. The object was illuminated by a color photographing light bulb (adjusted to 5,500 ° K). For Specimens 101 to 107 and Specimen 110, the F value was 28. For Specimens 108 and 109, the F value was 1.4 2/3. The shutter speed was 1/1000". The luminance on the gray card was adjusted to correspond to that of EV-11.

The films thus exposed were then subjected to the same color development as used when the specific sensitivity was determined. These films were then measured for blue, green and red densities with the above described status M filter. As can be seen in Table 1, the present specimens 101 to 103, 107 and 110 were less susceptible to underexposure in the automatic exposure mode utilizing reflection by the film surface than the comparative. Specimens 105 and 106. The present invention thus provided superior results by preventing underexposure. Specimen 102 was more excellent than Specimen 101. Furthermore, Specimen 103 was more excellent than Specimen 102. Specimen 104 is not preferred because of too low a reflectance, leading to overexposure.

TABLE 1

| Specimen | Specific Sensitivity | Spectralin reflectance (600 nm) (%) | Density photographing automatic exposure mode with strobe | | | Density in manual photographing | | |
|---|---|---|---|---|---|---|---|---|
| | | | B | G | R | B | G | R |
| 101 (present invention | 400 | 34 | 1.69 | 1.29 | 0.98 | 1.71 | 1.31 | 1.00 |
| 102 (present invention) | 400 | 32 | 1.70 | 1.31 | 0.99 | 1.71 | 1.32 | 1.01 |
| 103 (present invention) | 402 | 29 | 1.73 | 1.31 | 1.01 | 1.73 | 1.32 | 1.01 |
| 104 (comparative) | 401 | 19 | 1.62 | 1.28 | 0.94 | 1.58 | 1.24 | 0.90 |
| 105 (comparative) | 392 | 37 | 1.60 | 1.33 | 1.00 | 1.63 | 1.37 | 1.04 |
| 106 (comparative) | 382 | 41 | 1.76 | 1.36 | 1.00 | 1.84 | 1.44 | 1.07 |

TABLE 1-continued

| Specimen | Specific Sensitivity | Spectralin reflectance (600 nm) (%) | Density photographing automatic exposure mode with strobe B | G | R | Density photographing manual photographing B | G | R |
|---|---|---|---|---|---|---|---|---|
| 107 (present invention) | 392 | 31 | 1.85 | 1.44 | 1.08 | .185 | 1.45 | 1.09 |
| 108 (comparative) | 160 | 32 | 1.91 | 1.47 | 1.10 | 1.91 | 1.47 | 1.12 |
| 109 (comparative) | 162 | 28 | 1.90 | 1.64 | 1.42 | 1.89 | 1.63 | 1.41 |
| 110 (present invention) | 400 | 31 | 1.70 | 1.25 | 0.91 | 1.73 | 1.26 | 0.91 |

As described above, a color photographic material having a specific sensitivity of 320 or more and a surface spectral reflectance of the film surface (emulsion side) at 600 mn of from 20% to less than 35%, preferably 25% to less than 33%, particularly 25% to less than 30%, prepared according to the present invention, is useful for prevention of a reduction in the sensitivity when an automatic exposure camera utilizing reflection by the film surface is employed for photographing.

While the invention has been described in detail and with reference to specific embodiments thereof, it will be apparent to one skilled in the art that various changes and modifications can be made therein without departing form the spirit and scope thereof.

What is claimed is:

1. A silver halide color photographic material comprising a support having thereon at least one red-sensitive silver halide emulsion layer, at least one green-sensitive silver halide emulsion layer, and at least one blue-sensitive silver halide emulsion layer, provided outwardly from said support, said material having a specific photographic sensitivity of from 320 to 800 and a surface spectral reflectance of from 20% to less than 35% at a wavelength of 600 nm on the emulsion side film surface.

2. The silver halide color photographic material as claimed in claim 1, wherein the combined total of silver contents in said material is 3.0 to 9.0 g/m$^2$.

3. The silver halide color photographic material as in claim 1, having a surface spectral reflectance of from 25% to less than 33% at a wavelength of 600 nm.

4. The silver halide color photographic material as claimed in claim 3, having a surface spectral reflectance of from 25% to less than 30% at a wavelength of 600 nm.

5. The silver halide color photographic material as claimed in claim 1, wherein at least one light-sensitive emulsion layer comprises at least two sub-layers, having substantially similar spectral sensitivities, but substantially different inherent sensitivities, the outermost of said sub-layers from said support having a lower silver content than each of said sub-layers nearer to said support.

6. The silver halide color photographic material as claimed in claim 1, wherein said silver halide comprises metals other than silver, gold and iridium in amounts up to 3 ppm.

7. The silver halide color photographic material as claimed in claim 5, wherein the emulsion layer having the highest sensitivity of said sub-layers has a silver content of 0.3 to 1.8 g/m$^2$.

8. The silver halide color photographic material as claimed in claim 7, wherein the emulsion layer having the highest sensitivity of said sub-layers has a silver content of 0.3 to 1.6 g/m$^2$.

9. The silver halide color photographic material as claimed in claim 8, wherein the emulsion layer having the highest sensitivity of said sub-layers has a silver content of 0.3 to 1.4 g/m$^2$.

10. The silver halide color photographic material as claimed in claim 1, wherein said silver halide is silver bromoiodide containing 2 to 20 mol % of silver iodide.

11. The silver halide color photographic material as claimed in claim 10, wherein said silver halide comprises grains comprising a core of silver bromoiodide having a silver iodide content of at least 5 mol %, and a shell around said core comprising silver bromide or silver bromoiodide with a lower silver iodide content than said core.

12. The silver halide color photographic material as claimed in claim 11, wherein said core comprises from 20 to 44 mol % of silver iodide and said shell comprises at most 5 mol % of silver iodide.

13. The silver halide color photographic material as claimed in claim 5, wherein the emulsion layer having the highest sensitivity of said sub-layers contains silver halide grains having an average size of 0.5 to 4 μm.

14. The silver halide color photographic material as claimed in claim 1, wherein said silver halide emulsion comprises a supersensitizing compound represented by formula (I):

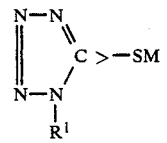

(I)

wherein $R^1$ represents an aliphatic, aromatic or heterocyclic group, each being substituted with at least one —COOM or —$SO_3M$ group, wherein M represents hydrogen, an alkali metal, a quaternary ammonium group or a quaternary phosphonium group.

15. The silver halide color photographic material as claimed in claim 1, wherein said red-sensitive silver halide emulsion layer comprises at least one cyan coupler, said green-sensitive silver halide emulsion layer comprises at least one magenta coupler and said blue-sensitive emulsion layer comprises at least one yellow coupler, at least one of said couplers being a high speed reaction coupler.

16. The silver halide color photographic material as claimed in claim 1, wherein at least one of said silver halide emulsion layers or a layer adjacent thereto comprises from $10^{-7}$ to 0.2 mol of compound capable of forming a development inhibitor or a fogging agent upon silver development, per mol of silver in said silver halide emulsion layer.

17. The silver halide color photographic material as claimed in claim 1, further comprising a yellow filter layer containing a yellow filter dye represented by formula (II):

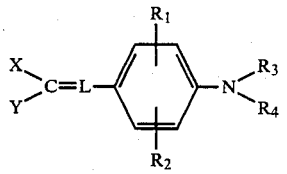

[II]

wherein X and Y, which may be the same or different, each represents a cyano group, a carboxyl group, an alkylcarbonyl group, an arylcarbonyl group, an alkoxycarbonyl group, an aryloxycarbonyl group, a carbamoyl group, a sulfonyl group or a sulfamoyl group, provided that when either of X and Y represents a cyano group, the other represents a group other than an alkylcarbonyl group or a sulfonyl group; $R_1$ and $R_2$, which may be the same or different, each represents hydrogen, a halogen atom, an alkyl group, an alkoxy group, a hydroxyl group, a carboxyl group, a substituted amino group, a carbamoyl group, a sulfamoyl group, or an alkoxycarbonyl group; $R_3$ and $R_4$, which may be the same or different, each represents hydrogen, an alkyl group or an aryl group; $R_3$ and $R_4$ may be linked to form a 5-membered or 6-membered ring; $R_1$ and $R_3$ may be linked to form a 5-membered or 6membered ring; and L represents a methine group.

* * * * *